US008342293B2

(12) United States Patent
Ito

(10) Patent No.: US 8,342,293 B2
(45) Date of Patent: Jan. 1, 2013

(54) MAGNETIC GUIDING APPARATUS OF ELEVATOR

(75) Inventor: Hiroaki Ito, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 278 days.

(21) Appl. No.: 12/860,202

(22) Filed: Aug. 20, 2010

(65) Prior Publication Data

US 2011/0056773 A1 Mar. 10, 2011

(30) Foreign Application Priority Data

Sep. 8, 2009 (JP) ..... 2009-207315

(51) Int. Cl.
*B66B 1/34* (2006.01)

(52) U.S. Cl. ..... 187/292; 361/144

(58) Field of Classification Search ..... 187/277, 187/289, 292, 293, 296, 297, 391–393, 401, 187/409, 410; 318/799–815, 600, 609, 610, 318/611, 623; 310/12.15, 12.24–12.27; 361/143, 361/144, 146, 152, 154
See application file for complete search history.

(56) References Cited

U.S. PATENT DOCUMENTS

| | | | | |
|---|---|---|---|---|
| 5,652,414 | A * | 7/1997 | Roberts et al. | 187/292 |
| 5,749,444 | A * | 5/1998 | Skalski | 187/409 |
| 6,305,502 | B1 * | 10/2001 | He et al. | 187/292 |
| 6,408,987 | B2 * | 6/2002 | Morishita | 187/292 |
| 7,218,196 | B2 * | 5/2007 | Nakao et al. | 336/83 |
| 7,793,760 | B2 * | 9/2010 | Ito et al. | 187/292 |
| 7,841,451 | B2 | 11/2010 | Ito | |
| 7,909,141 | B2 * | 3/2011 | Utsunomiya | 187/292 |
| 8,002,086 | B2 * | 8/2011 | Ito | 187/292 |
| 8,091,686 | B2 * | 1/2012 | Ito | 187/292 |
| 8,201,665 | B2 * | 6/2012 | Gieras et al. | 187/315 |
| 8,264,311 | B2 | 9/2012 | Ito et al. | |
| 2002/0179377 | A1 * | 12/2002 | Higaki et al. | 187/292 |
| 2008/0110701 | A1 | 5/2008 | Ito et al. | |
| 2008/0257655 | A1 | 10/2008 | Ito et al. | |
| 2009/0065309 | A1 | 3/2009 | Ito | |
| 2009/0133970 | A1 | 5/2009 | Ito | |
| 2009/0173583 | A1 | 7/2009 | Ito | |
| 2011/0162914 | A1 | 7/2011 | Ito et al. | |

FOREIGN PATENT DOCUMENTS

| | | | |
|---|---|---|---|
| CN | 1972857 | A | 5/2007 |
| CN | 101098824 | A | 1/2008 |
| CN | 101386388 | A | 3/2009 |
| CN | 101475113 | A | 7/2009 |
| CN | 101506081 | A | 8/2009 |
| JP | 2005-350267 | A | 12/2005 |

* cited by examiner

*Primary Examiner* — Anthony Salata
(74) *Attorney, Agent, or Firm* — Foley & Lardner LLP

(57) ABSTRACT

A guide apparatus includes a pair of guide rails, magnet units, pedestals, a sensor unit, a magnetic guide control apparatus as a control unit, and projected parts. The magnet unit includes electromagnets and permanent magnets and magnetic poles thereof are opposed to a blade of the guide rail from three directions with a gap. The projected parts are formed with side parts of a tip part of a central magnetic pole opposite to a tip surface of the blade of the guide rail among the magnetic poles of the magnet unit being brought closer to the guide rail than a center section thereof.

10 Claims, 15 Drawing Sheets

MAGNETIC GUIDING APPARATUS OF ELEVATOR

CROSS-REFERENCE TO RELATED APPLICATIONS

This application is based upon and claims the benefit of priority from Japanese Patent Application No. 2009-207315, filed Sep. 8, 2009; the entire contents of which are incorporated herein by reference.

FIELD

Embodiments described herein relate generally to a guiding apparatus which is mounted on a cage of an elevator to guide the cage along guide rails and holds the guide rails by a magnetic force.

BACKGROUND

In an elevator, a cage is hung in an elevator-shaft by a main rope put on a traction machine and the cage is moved by driving the traction machine. The cage comprises a guiding apparatus to move along guide rails laid in a vertical direction inside the elevator-shaft. The cage is subjected to forces in directions crossing the direction of movement while moving, depending on locations where passengers are standing or baggage is placed or the weight thereof. To sustain such forces, the guiding apparatus holds the cage with a sufficient force.

Guiding apparatuses are divided into contact guiding apparatuses and noncontact magnetic guiding apparatuses. A contact guiding apparatus comprises rollers and shoes in contact with the guide rail. A magnetic guiding apparatus holds the cage in a noncontact manner by maintaining a gap to the guide rail with a magnetic force. For the contact guiding apparatus, vibration originating from irregularities on the surface of the guide rail or joints may be transmitted from rollers or shoes, or noise of roller rotation or noise of shoe abrasion may be caused. In this respect, vibration and noise are reduced for the magnetic guiding apparatus due to noncontact.

Jpn. Pat. Applin. KOKAI Publication No. 2005-350267 discloses a magnetic guiding apparatus comprising a magnet unit configured in an E shape enclosing a blade of the guide rail. The magnet unit of the guiding apparatus comprises a central electromagnet, first and second electromagnets, and first and second permanent magnets. The central electromagnet is arranged at a position opposite to the tip of the blade of the guide rail. The first and second electromagnets are arranged as a pair on both sides by nipping the blade of the guide rail therebetween. The first and second permanent magnets are connected between the first electromagnet and the central electromagnet and between the second electromagnet and the central electromagnet respectively in such a way that a magnetic flux is in line. The central electromagnet contains a third electromagnet and a fourth electromagnet. The third electromagnet is arranged in a forward portion leading to the first permanent magnet. The fourth electromagnet is arranged in a forward portion leading to the second permanent magnet.

The guiding apparatus described in Jpn. Pat. Applin. KOKAI Publication No. 2005-350267 comprises a gap sensor. The gap sensor measures the distance between the blade of the guide rail and a magnetic pole end of each of the central electromagnet and the first and second electromagnets. A cage comprises the guiding apparatus in an upper part and a lower part thereof for each of the guide rails arranged on both sides, i.e., four locations in total. The guiding apparatus individually controls the force of attraction between the guide rail and each magnetic pole based on a detection signal of the gap sensor and the value of current passed through each electromagnet. By integratively controlling the four guiding apparatuses, the elevator stabilizes the posture of the cage.

For the guiding apparatus described in Jpn. Pat. Applin. KOKAI Publication No. 2005-350267, it is necessary to increase the size of the guiding apparatus itself to generate the sufficient force of attraction with respect to the guide rail by a magnetic force. If a magnetic guiding apparatus increases in size, not only the weight thereof, but also the unit price of permanent magnets increases. Four guiding apparatuses are mounted and thus, even if each guiding apparatus grows in size only slightly, the maximum load of the cage is restricted and manufacturing costs of the elevator are raised.

DETAILED DESCRIPTION

Figure 1:
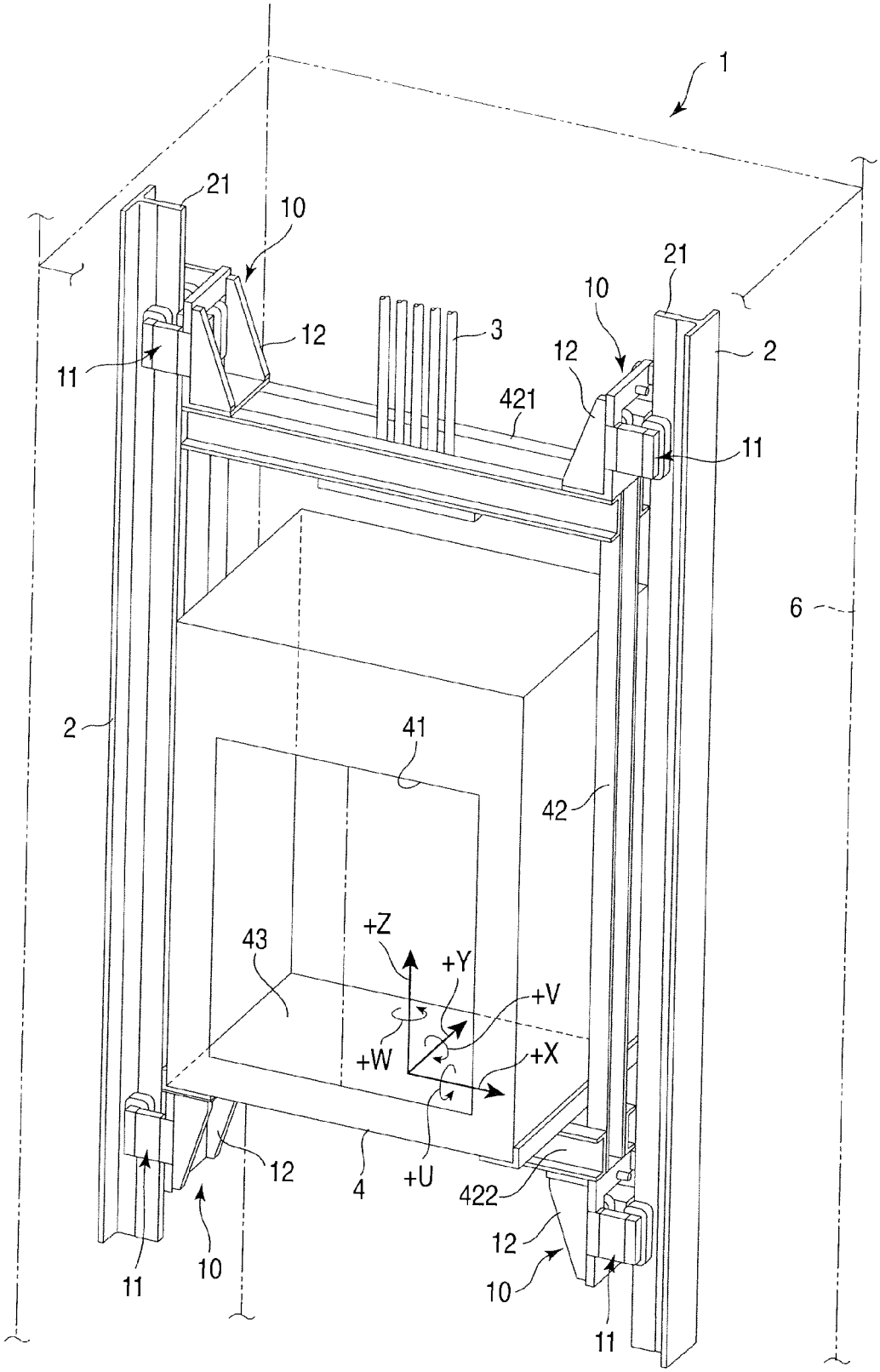
FIG. 1 is a perspective view showing a cage of an elevator comprising a guiding apparatus according to a first embodiment.

These embodiments provide a magnetic guiding apparatus generating stable holding power without increasing the volume by arranging the direction of a magnetic force, which is formed by inclusive permanent magnets, with respect to the guide rail.

A guiding apparatus according to an embodiment is mounted on a cage of an elevator to guide the cage by holding the cage with a magnetic force in a noncontact manner with respect to the guide rail. The guiding apparatus comprises a pair of guide rails, magnet units, pedestals, a sensor unit, a control unit, and projected parts. The pair of guide rails is formed of a magnetic substance and is laid in the vertical direction inside the elevator-shaft. The magnet units comprise electromagnets, permanent magnets, and magnetic poles opposed to a blade of the guide rail from three directions with a gap. The pedestals fasten the magnet unit to the cage arranged between the guide rails. The sensor unit detects physical quantities in a magnetic circuit formed by the guide rails and the magnet unit. Based on such physical quantities, the control unit controls a current passed through electromagnets for supporting the cage with respect to the guide rail in a noncontact manner. The projected part is formed at each of both ends of a tip portion of a central magnetic pole, which is among magnetic poles of the magnet unit, opposite to a tip surface of the blade of the guide rail closer to the guide rail than a center part thereof.

Internal dimensions of a recess formed between projected parts of the central magnetic pole are made equal to or smaller than the thickness of the blade of the guide rail so that sufficient holding power is exerted in the thickness direction of the blade of the guide rail even when the cage is displaced within an allowable range of displacement thereof. External dimensions of the tip part of the central magnetic pole along the thickness direction of the blade of the guide rail is made equal to or greater than the sum of the thickness of the blade of the guide rail and the allowable range of displacement of the cage with respect to the guide rail. External dimensions of each of the projected parts of the central magnetic pole along the thickness direction of the blade of the guide rail are made equal to or more than the sum of the thickness of the blade of the guide rail and the allowable range of displacement of the cage with respect to the guide rail. Internal dimensions of a recess formed between the projected parts of the central magnetic pole are made greater than the sum of the thickness of the blade of the guide rail and the allowable range of displacement of the cage with respect to the guide rail and the tip of the projected parts of the central magnetic pole extends beyond the tip surface of the blade of the guide rail when the central magnetic pole is positioned closest to the guide rail in the extension direction of the blade of the guide rail within the allowable range of displacement of the cage.

Other two magnetic poles of magnetic poles of the magnet unit other than the central magnetic pole are a first lateral magnetic pole and a second lateral magnetic pole. The first lateral magnetic pole and the second lateral magnetic pole are homopolar and have the polarity opposite to that of the central magnetic pole. The first lateral magnetic pole and the second lateral magnetic pole are arranged on both sides of the blade of the guide rail opposite to each other in the thickness direction and perpendicular to the central magnetic pole. The magnet unit comprises an iron core, a first permanent magnet, a second permanent magnet, a first electromagnet, and a second electromagnet. The iron core comprises the central magnetic pole, the first lateral magnetic pole, and the second lateral magnetic pole at each end thereof. The iron core is configured by a T-shaped portion from the central magnetic pole to connection parts with the first and second permanent magnets and I-shaped portions from the first lateral magnetic pole to the connection part with the first permanent magnet and from the second lateral magnetic pole to the connection part with the second permanent magnet. The first permanent magnet is arranged between the central magnetic pole and the first lateral magnetic pole in an orientation in which the polarity of each is formed in the central magnetic pole and the first lateral magnetic pole. The second permanent magnet is arranged between the central magnetic pole and the second lateral magnetic pole in an orientation in which the polarity of each is formed in the central magnetic pole and the second lateral magnetic pole. The first electromagnet comprises a first coil wound around the iron core in an orientation crossing a first main magnetic flux of a first magnetic circuit passing through the first permanent magnet. The second electromagnet comprises a second coil wound around the iron core in an orientation crossing a second main magnetic flux of a second magnetic circuit passing through the second permanent magnet.

To reinforce the magnetic force of each magnetic pole attracting the guide rail, the magnet unit connects outer circumferential sides adjacent to each other in an interval connecting the central magnetic pole through the first lateral magnetic pole and outer circumferential sides adjacent to each other in an interval connecting the central magnetic pole through the second lateral magnetic pole at an angle of 90 degrees or more at least in one location. Moreover, the tip part opposite to the guide rail of at least one of the central magnetic pole, the first lateral magnetic pole, and the second lateral magnetic pole is formed in a tapered shape in which the cross section decreases as the guide rail comes closer.

To make control of the magnetic force of each magnetic pole easier, the first coil is provided in at least one of the interval between the central magnetic pole and the first permanent magnet and the interval between the first permanent magnet and the first lateral magnetic pole and the second coil is provided in each of the interval between the central magnetic pole and the second permanent magnet and the interval between the second permanent magnet and the second lateral magnetic pole.

To reduce power consumption by the guiding apparatus, the control unit stabilizes the posture of the cage based on physical quantities detected by the sensor unit and also controls the current passed through electromagnets so that the current passing through electromagnets is caused to converge to zero.

The cage is subjected to external forces such as a force displacing the cage in a horizontal direction and rotation moment (torque) causing the cage to tilt due to the deviation of distribution of load on the floor. Even in such cases, the cage is displaced in a direction that cancels out such external forces within the allowable range of displacement by controlling the magnetic force of electromagnets of the guiding apparatus. Then, magnetic poles in a direction opposite to the direction in which external forces act are brought closer to the guide rail to increase action of the magnetic force of permanent magnets on the side brought closer to the guide rail so that the deviation of the magnetic force caused by the permanent magnets and external forces are balanced. If external forces do not fluctuate, the guiding apparatus holds the cage in a noncontact manner with respect to the guide rail by the magnetic force caused by permanent magnets even if the magnetic force by electromagnets is reduced close to zero.

The magnetic force acting in the direction in which the blade of the guide rail extends is originally a force that is easily obtained as a strong force because the magnetic flux formed by the first and second permanent magnets contributes to the magnetic force. By contrast, the magnetic force acting in the thickness direction of the blade of the guide rail has only a contribution of a magnetic flux formed by one of the first and second permanent magnets.

Furthermore, a guiding apparatus according to an embodiment comprises projected parts at each of both ends of the tip part of the central magnetic pole and thus, the magnetic force generated by the central magnetic pole on the guide rail has a component generated in the thickness direction of the blade of the guide rail. Therefore, the magnetic force generated by each guiding apparatus in the thickness direction of the blade of the guide rail is reinforced without increasing the volume of the guiding apparatus.

A guiding apparatus 10 according to the first embodiment will be described with reference to FIGS. 1 to 5. The guiding apparatus 10 is provided, as shown in FIG. 1, on a cage 4 of an elevator 1. The elevator 1 comprises a pair of guide rails 2 made of iron, which is a ferromagnetic substance, arranged in side parts when viewed from an entrance 41 side of the cage 4. The guiding apparatus 10 is mounted, corresponding to the guide rails 2, on an upper beam 421 and a lower beam 422 of a cage frame 42 of the cage 4 in each of side parts, i.e., four locations in total. The cage 4 is hung by a main rope 3 put on a traction machine. Each of the guiding apparatuses 10 generates a magnetic force on an blade 21 of the guide rail 2 to hold the cage in a noncontact manner. The cage 4 is moved in an elevator-shaft 6 along the guide rails 2 by being driven by the traction machine.

For convenience of description herein, the center section of a floor 43 of the cage 4 shown in FIG. 1 is set as a "reference" and when viewing into the cage 4 from the entrance 41 side of the case 4, the right direction is defined as a "+X side", the left direction as a "−X side", the inward side as a "+Y side", the entrance 41 side from the "reference" as a "−Y side", the upper side from the floor 43 as a "+Z side", and the lower side from the floor 43 as a "−Z side". Also, the clockwise direction when viewing in the +X direction from the "reference" is defined as "+U", the counterclockwise direction as "−U", the clockwise direction when viewing in the +Y direction from the "reference" as "+V", the counterclockwise direction as "−V", the clockwise direction when viewing in the +Z direction from the "reference" as "+W", and the counterclockwise direction as "−W".

The elevator 1 stabilizes the posture of the cage 4 by integratively controlling the four guiding apparatuses 10 to hold the cage 4 with respect to the guide rail 2 in a noncontact manner. Each of the guiding apparatuses 10 has the same configuration. Thus, a description below will be provided by taking the guiding apparatus 10 in a +X and +Z position, or the upper right guiding apparatus 10 when viewed from the entrance 41 side as an example.

Figure 2:
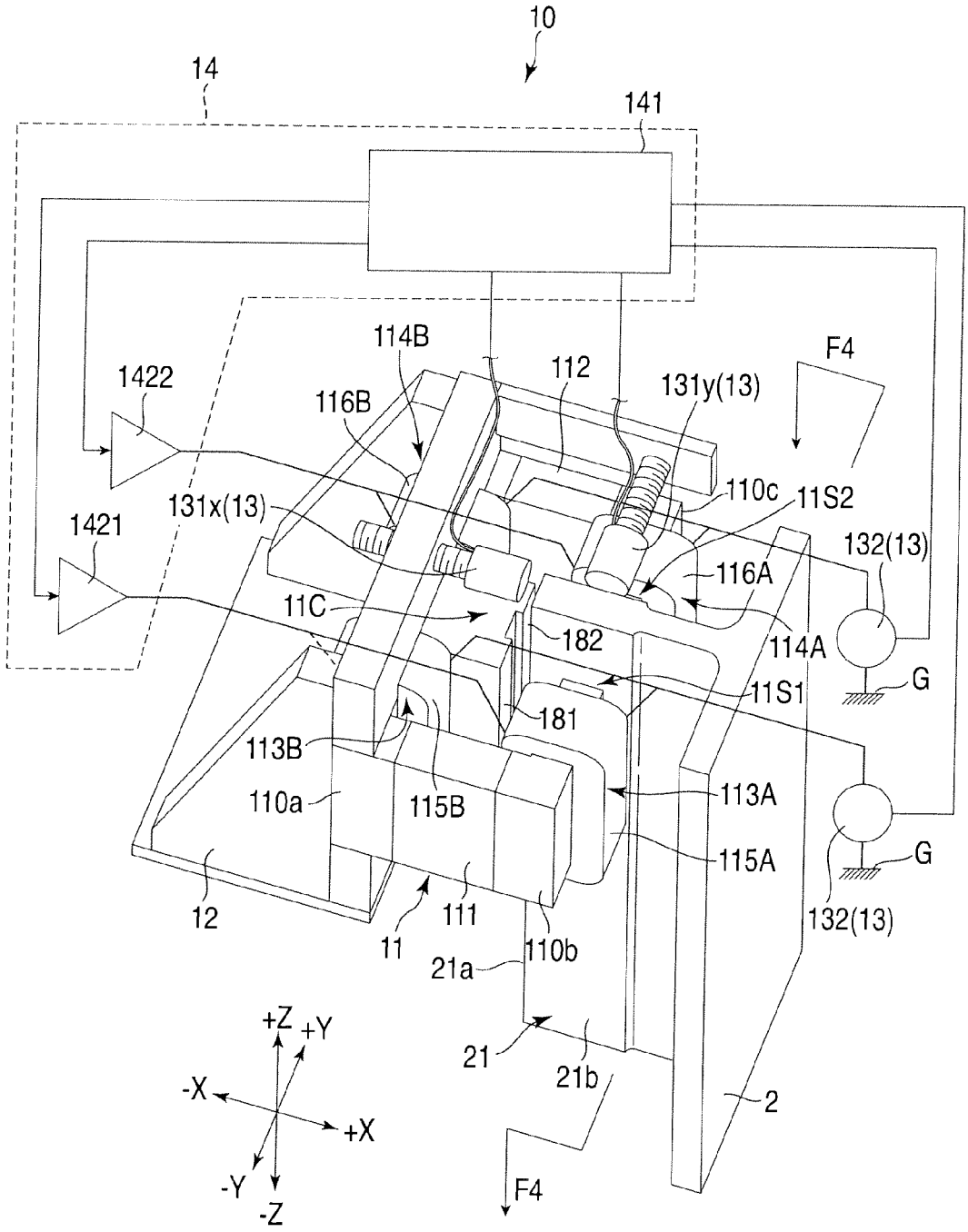
FIG. 2 is a block diagram of the guiding apparatus shown in FIG. 1.

The guiding apparatus 10 comprises, as shown in FIG. 2, a magnet unit 11, a pedestal 12, a sensor unit 13, and a magnetic guide control apparatus 14. The magnet unit 11 comprises, as shown in FIG. 3, an iron core 110, a first permanent magnet 111, a second permanent magnet 112, first electromagnets 113A, 113B and second electromagnets 114A, 114B.

Figure 4:
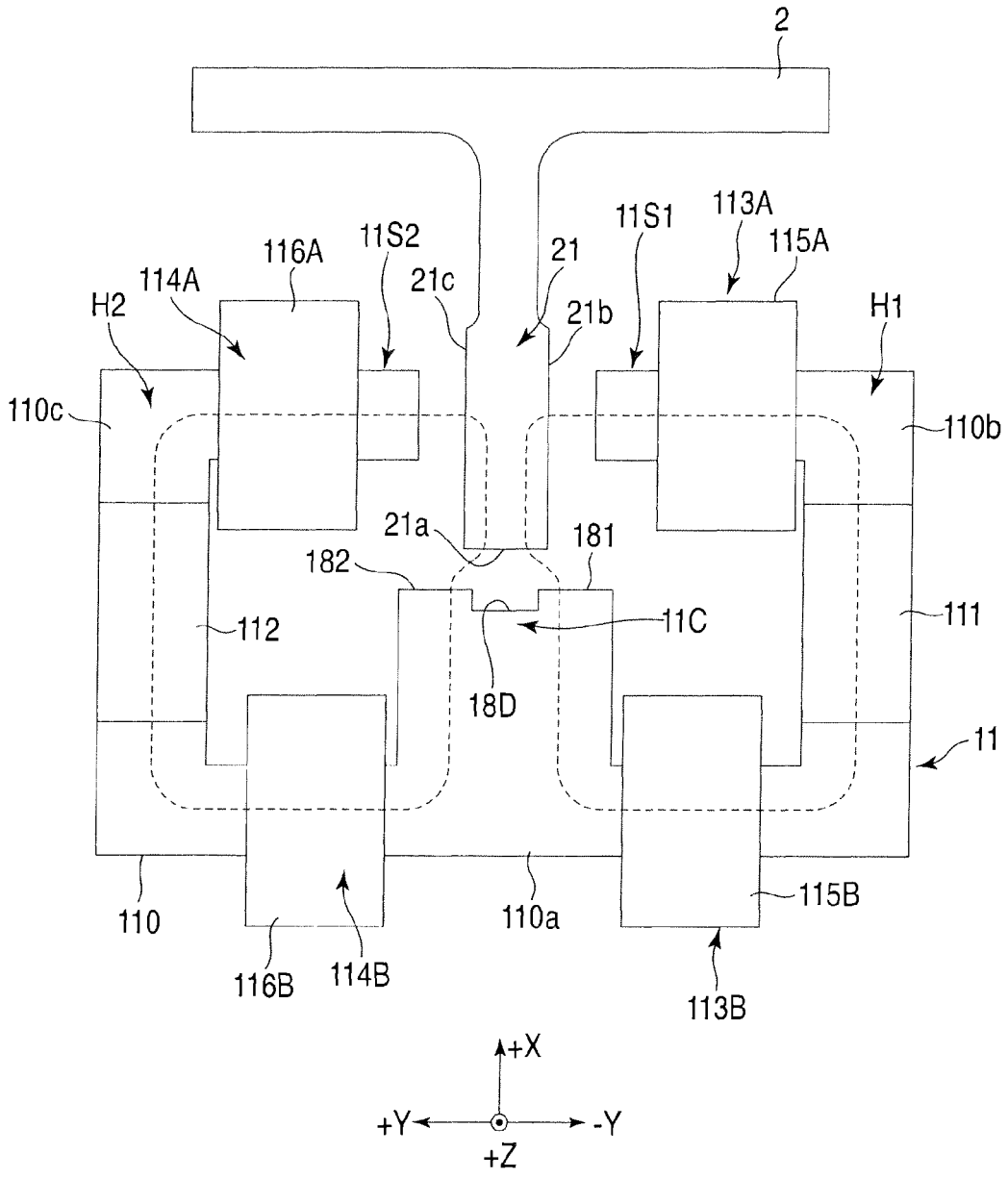
FIG. 4 is a plan view of the magnet unit and a guide rail along an F4-F4 line in FIG. 2.
Figure 5:
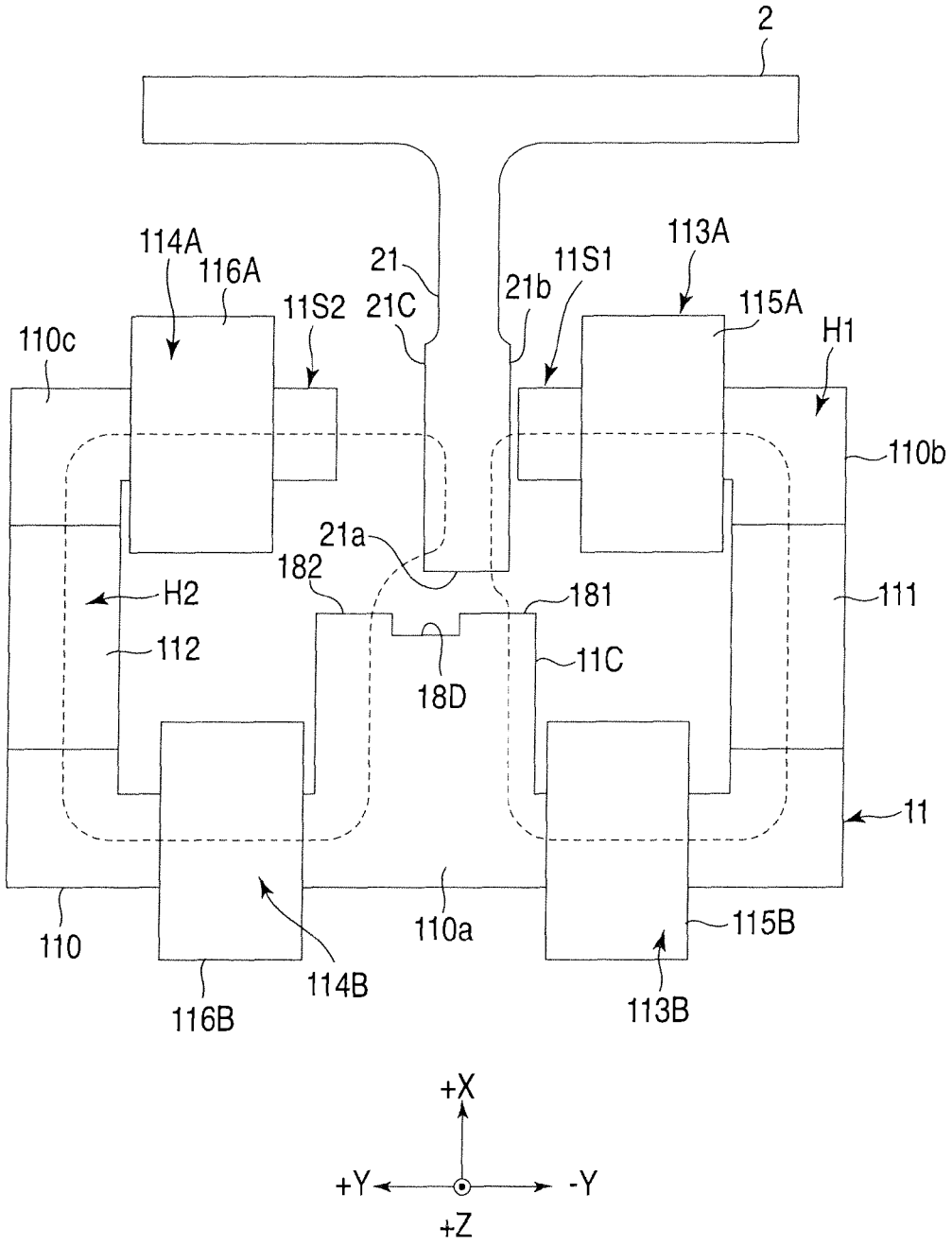
FIG. 5 is a plan view when the magnet unit shown in FIG. 4 is displaced in a thickness direction of a blade with respect to the guide rail.

The magnet unit 11 is formed, as shown in FIG. 4, in an E shape in which ends thereof are opposed to the blade 21 of the guide rail 2 from three directions with a space. The iron core 110 comprises a central iron core 110*a* forming a central magnetic pole 11C, a first lateral iron core 110*b* forming a first lateral magnetic pole 11S1, and a second lateral iron core 110*c* forming a second lateral magnetic pole 11S2. The central magnetic pole 11C is arranged at a position opposite to a tip surface 21*a* of the blade 21 of the guide rail 2 with a gap. The first lateral magnetic pole 11S1 is arranged at a position opposite to a side 21*b* on the −Y side of the blade 21 of the guide rail 2 with a gap. The second lateral magnetic pole 11S2 is arranged at a position opposite to a side 21*c* on the +Y side of the blade 21 of the guide rail 2 with a gap. That is, the first lateral magnetic pole 11S1 and the second lateral magnetic pole 11S2 are arranged opposite to each other sandwiching the blade 21 of the guide rail 2 on both sides in the thickness direction thereof and in a direction perpendicular to the central magnetic pole 11C.

The tip part of the central magnetic pole 11C comprises, as shown in FIG. 4, projected parts 181, 182 at both ends opposite to the tip surface 21*a* of the blade 21 of the guide rail 2. The projected parts 181, 182 are formed with a fixed width closer to the guide rail 2 side than the center section. Therefore, a recess 18D is formed between the projected parts 181 and 182. External dimensions of the tip part of the central magnetic pole 11C are formed equal to or greater than the sum of the thickness of the blade 21 of the guide rail 2 and the allowable range of displacement of the cage 4 with respect to the guide rail. Internal dimensions of the recess 18D of the central magnetic pole 11C are formed equal to or smaller than the thickness of the blade 21 of the guide rail 2. Further, external dimensions of the projected parts 181, 182 along the thickness direction of the blade 21 of the guide rail 2 are preferably greater than the sum of the thickness of the blade 21 of the guide rail 2 and the allowable range of displacement of the cage 4 with respect to the guide rail 2.

Figure 3:
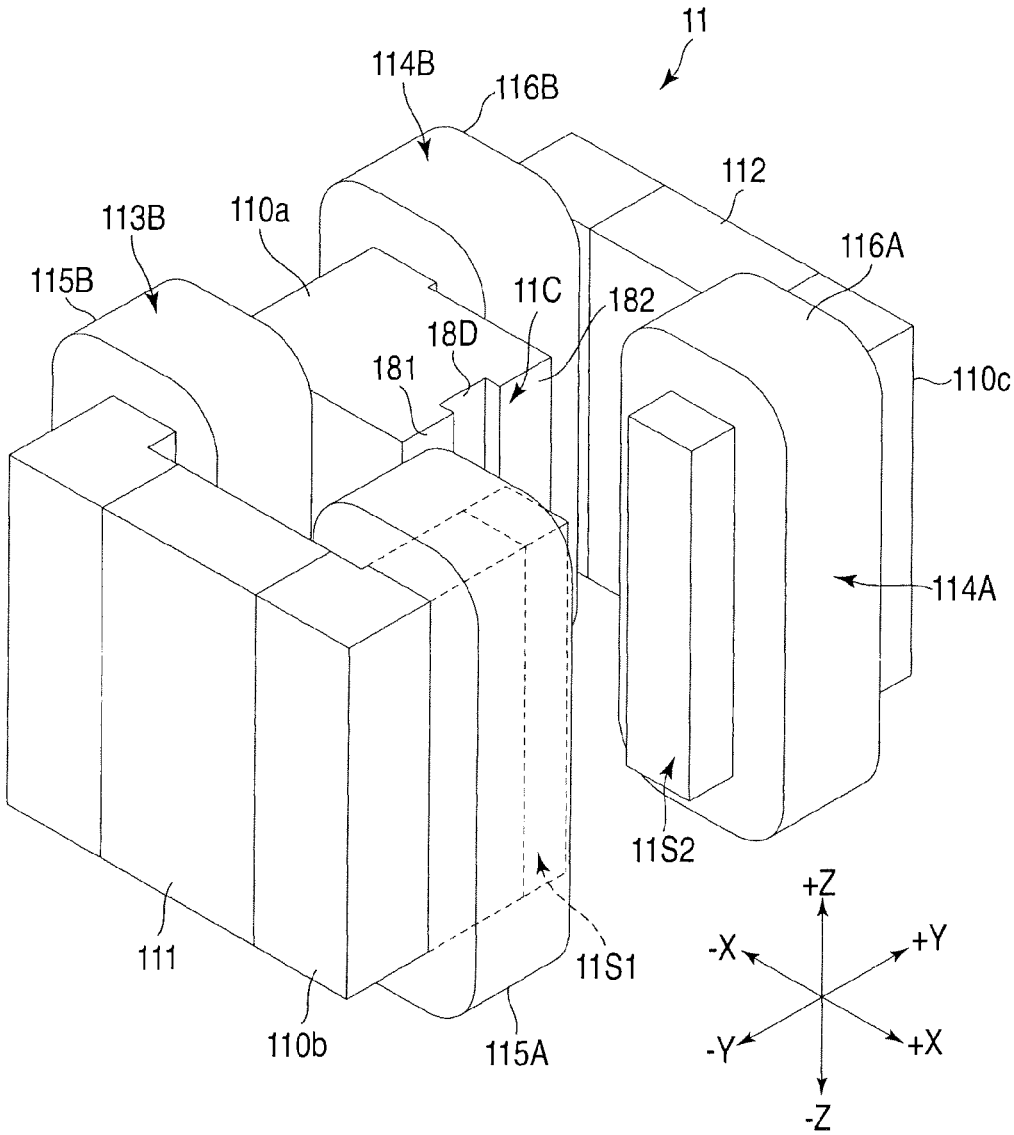
FIG. 3 is a perspective view of a magnet unit of the guiding apparatus shown in FIG. 2.

As shown in FIGS. 3 and 4, the first permanent magnet 111 is arranged between the central iron core 110*a* and the first lateral iron core 110*b* and the second permanent magnet 112 is arranged between the central iron core 110*a* and the second lateral iron core 110*c*. The first permanent magnet 111 and the second permanent magnet 112 are each arranged so that the same polarity is formed in the central magnetic pole 11C. Therefore, the first lateral magnetic pole 11S1 and the second lateral magnetic pole 11S2 have the different polarity from that of the central magnetic pole 11C and have the same polarity formed therein. If, for example, the first permanent magnet 111 is arranged with the N pole on the +X side and the S pole on the −X side, the second permanent magnet 112 is also arranged with the N pole on the +X side and the S pole on the −X side so that the first lateral magnetic pole 11S1 and the second lateral magnetic pole 11S2 become the N pole and the central magnetic pole 11C becomes the S pole. If the first permanent magnet 111 and the second permanent magnet 112 are arranged with their polarity in opposite direction, the polarity formed in the first lateral magnetic pole 11S1 and the second lateral magnetic pole 11S2 and that formed in the central magnetic pole 11C are naturally reversed.

As shown in FIG. 4, the first electromagnets 113A, 113B comprise first coils 115A, 115B wound in a direction crossing a first main magnetic flux of a first magnetic circuit H1 passing through the first permanent magnet 111. The second electromagnets 114A, 114B comprise second coils 116A, 116B wound in a direction crossing a second main magnetic flux of a second magnetic circuit H2 passing through the second permanent magnet 112. The first coil 115A is wound around the first lateral iron core 110*b* between the first permanent magnet and the first lateral magnetic pole and the first coil 115B is wound around the central iron core 110*a* between the central magnetic pole 11C and the first permanent magnet 111. The second coil 116A is wound around the second lateral iron core 110*c* between the second permanent magnet 112 and the second lateral magnetic pole and the second coil 116B is wound around the central iron core 110*a* between the central magnetic pole 11C and the second permanent magnet 112.

The pedestals 12 are each fixed, as shown in FIG. 1, to the ends facing the guide rails 2 of the upper beam 421 and the lower beam 422 of the cage frame 42 of the cage 4 to hold the magnet unit 11 at a position where, as shown in FIG. 4, the central magnetic pole 11C, the first lateral magnetic pole 11S1, and the second lateral magnetic pole 11S2 are each opposite to the surface of the blade 21 of the guide rail 2 with a gap. Accordingly, the first magnetic circuit H1 is formed so as to pass through the first permanent magnet 111, the first lateral iron core 110*b*, the blade 21 of the guide rail 2, and the central iron core 110*a*. Similarly, the second magnetic circuit H2 is formed so as to pass through the second permanent magnet 112, the second lateral iron core 110*c*, the blade 21 of the guide rail 2, and the central iron core 110*a*.

The sensor unit 13 detects physical quantities related to the first magnetic circuit H1 and the second magnetic circuit H2 formed of the magnet unit 11 and the guide rails 2 shown in FIG. 2. The sensor unit 13 is configured by gap sensors 131*x*, 131*y* and a current detector 132. The gap sensor 131*x* is fixed, as shown in FIG. 2, to the pedestal 12 opposite to the tip surface 21*a* of the blade 21 of the guide rail 2. The gap sensor 131*y* is fixed to the pedestal 12 opposite to the side 21*c* on the −Y side of the blade 21 of the guide rail 2. The current detectors 132 are each connected, as shown in FIG. 2, between the first coils 115A, 115B and a ground G and between the second coils 116A, 116B and the ground G to detect a current passed through each of the coils 115A, 115B, 116A, and 116B.

The gap sensor 131*y* is used to detect how much the first lateral magnetic pole 11S1 and the second lateral magnetic pole 11S2 are displaced in the thickness direction of the blade 21, that is, the Y direction with respect to the blade 21 of the guide rail 2. Therefore, the gap sensor 131*y* may be arranged facing the side 21*b* on the +Y side of the blade 21 of the guide rail 2 or on both sides of the +Y side and the −Y side.

The magnetic guide control apparatus 14 is a control unit that supports the cage 4 with respect to the guide rails 2 in a noncontact manner by controlling the voltage excited in electromagnets based on physical quantities detected by the sensor unit 13 and comprises, as shown in FIG. 2, a control computing unit 141, a first driver 1421, and a second driver 1422. The control computing unit 141 calculates voltages to be applied to each coil of the magnet unit 11 to support the cage 4 with respect to the guide rail 2 in a noncontact manner based on a signal obtained from the sensor unit 13.

The first driver 1421 is connected to each of the first coils 115A, 115B to supply power to each coil based on output of the control computing unit 141. The second driver 1422 is connected to each of the second coils 116A, 116B to supply power to each coil based on output of the control computing unit.

In the present embodiment, physical quantities, which are related to the first magnetic circuit H1 and the second magnetic circuit H2 detected by each of the gap sensors 131*x*, 131*y* and the current detector 132 constituting the sensor unit 13, include the distance between the projected parts 181, 182 of the central magnetic pole 11C and the tip surface 21*a* of the blade 21 of the guide rail 2, the distance between the first or second lateral magnetic pole and the blade 21 of the guide rail 2, and the value of current passing through each of the first coils 115A, 115B and the second coils 116A, 116B.

Therefore, the control computing unit 141 exercises feedback control based on distances detected by the gap sensors 131*x*, 131*y*, and based on current values detected by the current detectors 132 due to supplied power. The control computing unit 141 adjusts magnetic forces acting on each of the central magnetic pole 11C, the first lateral magnetic pole 11S1, and the second lateral magnetic pole 11S2 by exciting the first coils 115A, 115B and the second coils 116A, 116B through the first driver 1421 and the second driver 1422. Hence, gaps between the magnetic poles 11C, 11S1, 11S2 and the guide rail 2 are maintained. As a result, the cage 4 is held with respect to the guide rail 2 in a noncontact manner.

When signals detected by the gap sensors 131*x*, 131*y* hardly change, the magnetic guide control apparatus 14 decreases the currents in each of the coils 115A, 115B, 116A, and 116B by exercising feedback control via an integrator so that the detected current value converges to zero while maintaining a noncontact magnetic force support state. When the cage 4 is stable with respect to the guide rail 2 without being subjected to external forces, all magnetic forces necessary to maintain the noncontact state is generated by the first permanent magnet 111 and the second permanent magnet 112 by causing currents passing through each of the coils 115A, 115B, 116A, and 116B to converge to zero. In such a case, the elevator 1 maintains the cage 4 with respect to the guide rail 2 in a noncontact manner by so-called "zero power control".

If an external force that changes the posture of the cage 4 acts such as when a passenger moves on the floor 43 of the cage 4, a new passenger gets on, or a passenger gets off, a change of detection signals of the gap sensors 131*x*, 131*y* and the current detectors 132 occurs. Thus, when the magnetic guide control apparatus 14 detects such a change, the magnetic guide control apparatus 14 supplies power to each of the coils 115A, 115B, 116A, and 116B to slightly displace the posture of the cage 4 to a position where external forces and magnetic forces are balanced. The amount of this displacement is extremely small and thus, passengers rarely perceive the change. Then, currents passing through each of the coils 115A, 115B, 116A, and 116B are caused to converge to zero when the posture of the cage 4 is stabilized again. As a result, external forces acting on the cage 4 and magnetic forces of the guiding apparatus 10 are balanced so that the cage 4 is held in a state in which the posture thereof is displaced.

Holding the cage 4 with respect to the guide rails 2 in a state in which magnetic forces of the first electromagnets 113A, 113B and the second electromagnets 114A, 114B are reduced to zero without supplying power to the first coils 115A, 115B and the second coils 116A, 116B is called the "zero power control". When "zero power control" applies, a force exerted by the guiding apparatus 10 as holding power originates from magnetic forces of the first permanent magnet 111 and the second permanent magnet 112. That is, the magnetic force formed by the first permanent magnet 111 and the second permanent magnet 112 between the guide rails 2 and the magnet unit 11 in accordance with a relative physical relationship therebetween becomes a guiding force to hold the cage 4.

When no external force acts on the cage 4, the magnet unit 11 of the guiding apparatus 10 configured as described above is held in a stable physical relationship shown in FIG. 4 with respect to the guide rails 2. As shown in FIG. 4, the first main magnetic flux of the first magnetic circuit H1 constituted by the first permanent magnet 111, the first lateral iron core 110*b*, and the central iron core 110*a* passes through the projected part 181 of the central magnetic pole 11C. Then, a magnetic flux originating from the first permanent magnet 111 and the first electromagnets 113A, 113B is formed between the projected part 181 and the tip surface 21*a* of the blade 21 of the guide rail 2 and between the first lateral magnetic pole 11S1 and the side 21*b* on the −Y side of the blade 21 of the guide rail 2. The second main magnetic flux of the second magnetic circuit H2 constituted by the second permanent magnet 112, the second lateral iron core 110*c*, and the central iron core 110*a* passes through the projected part 182 of the central magnetic pole 11C. Then, a magnetic flux originating from the second permanent magnet 112 and the second electromagnets 114A, 114B is formed between the projected part 182 and the tip surface 21*a* of the blade 21 of the guide rail 2 and between the second lateral magnetic pole 11S2 and the side 21*c* on the +Y side of the blade 21 of the guide rail 2. The first magnetic circuit H1 and the second magnetic circuit H2 pass through the same member magnetically connected by the central iron core 110*a* and a portion of the blade 21 of the guide rail 2. Therefore, the first magnetic circuit H1 and the second magnetic circuit H2 are mutually significantly affected by fluctuations of mutual magnetic flux density, that is, influences of the first permanent magnet 111 and the first electromagnets 113A, 113B, and the second permanent magnet 112 and the second electromagnets 114A, 114B.

A gap provided between the central magnetic pole 11C, the first lateral magnetic pole 11S1, and the second lateral magnetic pole 11S2 and the blade 21 of the guide rails 2 is adjusted by manipulating currents passed through the first coils 115A, 115B and the second coils 116A, 116B to change the magnetic force generated in each gap. Particularly, the central magnetic pole 11C in the present embodiment is provided with the projected parts 181, 182. Thus, the main magnetic flux of the first lateral magnetic pole 11S1 and that of the second lateral magnetic pole 11S2 pass through the projected parts 181, 182, respectively.

External dimensions of the tip part of the central magnetic pole 11C are equal to or greater than the sum of the thickness of the blade 21 of the guide rail 2 and the allowable range of displacement of the cage 4 with respect to the guide rail 2. Internal dimensions of the recess 18D formed between the projected parts 181, 182 are equal to or smaller than the thickness of the blade 21 of the guide rail 2. That is, most magnetic fluxes formed between the tip part of the central magnetic pole 11C and the tip surface 21*a* of the blade 21 of the guide rail 2 are formed so as to pass through the projected parts 181, 182. Incidentally, a portion of magnetic fluxes formed between the central magnetic pole 11C and the tip surface 21*a* of the blade 21 of the guide rail 2 is formed so as to pass through the recess 18D.

Therefore, as shown in FIG. 4, the magnetic force generated between the projected part 181 and the tip surface 21*a* of the guide rail 2 along the main magnetic flux of the first magnetic circuit H1 not only has a force in the −X direction along the direction in which the blade 21 of the guide rail 2 extends, but also attracts the guide rail 2 toward the projected part 181 in the −Y direction along the thickness direction of the blade 21 of the guide rail 2. The magnetic force generated between the projected part 182 and the tip surface 21*a* of the guide rail 2 along the main magnetic flux of the second magnetic circuit H2 not only has a force in the −X direction along the direction in which the blade 21 of the guide rail 2 extends, but also attracts the guide rail 2 toward the projected part 182 in the +Y direction along the thickness direction of the blade 21 of the guide rail 2. Actually, the guide rail 2 is fixed inside the elevator-shaft 6 and thus, the guiding apparatus 10 is brought closer to the guide rail 2.

The magnetic flux formed by the first permanent magnet 111 and that formed by the second permanent magnet 112 both pass through the central magnetic pole 11C in the magnet unit 11 of the guiding apparatus 10. Thus, a magnetic force stronger than that generated by the magnetic flux formed by the first lateral magnetic pole 11S1 and the second lateral magnetic pole 11S2 acts between the central magnetic pole 11C and the guide rail 2. In the present embodiment, a portion of the magnetic force attracting the guide rail 2 in the −X direction is caused to act in the −Y direction and the +Y direction by providing the projected parts 181, 182. Thus, the guiding apparatus 10 has improved capabilities to hold the guide rail 2 in the Y direction.

When the cage 4 is subjected to an external force in the −Y direction in FIG. 4, relative positions of the guide rail 2 and the magnet unit 11 change. The magnetic guide control apparatus 14 controls the first electromagnets 113A, 113B and the second electromagnets 114A, 114B so that the cage 4 is stabilized at a position where the magnetic force of the first permanent magnet 111 and the second permanent magnet 112 and the external force are balanced. More specifically, the magnetic guide control apparatus 14 controls each electromagnet to displace the magnet unit 11 in the +Y direction with respect to the guide rail 2 shown in FIG. 5. Accordingly, the first lateral magnetic pole 11S1 is brought closer to the side 21*b* on the −Y side of the blade 21 of the guide rail 2, reinforcing the magnetic force between the first lateral magnetic pole 11S1 and the guide rail 2.

Moreover, the relative distance between the projected part 181 on the −Y side of the central magnetic pole 11C and the tip surface 21*a* of the blade 21 of the guide rail 2 is decreased, increasing an overlapped area in the X direction of the projected part 181 and the tip surface 21*a*. As a result, the magnetic resistance of the first magnetic circuit H1 decreases and the magnetic flux density thereof increases, reinforcing the magnetic force of the whole first magnetic circuit H1. Further, a magnetic force that diagonally pulls the tip surface 21*a* of the guide rail 2 in both the −X direction and the −Y direction is formed between the tip surface 21*a* of the blade 21 of the guide rail 2 and the projected part 181.

Based on the above results, the guiding apparatus 10 cancels out external forces acting on the cage 4 by, in addition to a magnetic force in the +Y direction increased by bringing the first lateral magnetic pole 11S1 closer to the guide rail 2, a magnetic force acting diagonally between the projected part 181 and the tip surface 21*a* of the guide rail 2, and a magnetic force increased in the first magnetic circuit H1 by an increased overlapped area of the projected part 181 and the tip surface 21*a*. Thus, if the magnet unit 11 is displaced in the +Y direction (or the −Y direction) with respect to the guide rail 2 in the guiding apparatus 10, the magnetic force in the +Y direction (or the −Y direction) is reinforced more than an increase in magnetic force by bringing the first lateral magnetic pole 11S1 closer to the guide rail 2.

As described above, the rate of increase in magnetic force in the +Y direction or −Y direction when the magnet unit 11 is displaced in the +Y direction or −Y direction with respect to the guide rail 2 is improved in the guiding apparatus 10 by providing the projected parts 181, 182 in the central magnetic pole 11C.

The cage 4 is in the same state as the state in which the cage 4 is subjected to a force in the +Y direction and +U torque as external forces when a passenger stands near the entrance 41 of the elevator 1 having the guiding apparatus 10 configured as described above mounted at four corners of the cage frame 42 of the cage 4 as shown in FIG. 1. To hold the cage 4 against the external forces by "zero power control", the elevator 1 exercises control so that the guiding apparatus 10 at the upper right (+X, +Z) when the cage 4 is viewed from outside the entrance 41 and the guiding apparatus 10 at the upper left (−X, +Z) are displaced in the +Y direction and the guiding apparatus 10 at the lower right (+X, −Z) and the guiding apparatus 10 at the lower left (−X, −Z) are displaced in the −Y direction. When a passenger stands at the back of the cage 4, the cage 4 is in the same state as the state in which the cage 4 is subjected to a force in the −Y direction and −U torque as external forces. Therefore, to hold the cage 4 against the external forces by "zero power control", the elevator 1 exercises control so as to balance external forces and magnetic forces based on signals of the sensor unit 13 in each of the guiding apparatuses 10 so that the guiding apparatus 10 at the upper right (+X, +Z) and the guiding apparatus 10 at the upper left (−X, +Z) are displaced in the −Y direction and the guiding apparatus 10 at the lower right (+X, −Z) and the guiding apparatus 10 at the lower left (−X, −Z) are displaced in the +Y direction.

When a passenger stands on the forward left inner side (−X, −Y) of the entrance 41 viewed from outside the cage 4, the cage 4 is in the same state as the state in which the cage 4 is subjected to forces in the +X and +Y directions and −V and +U torque as external forces. In this case, to hold the cage 4 by "zero power control", the elevator 1 exercises control so as to balance external forces and magnetic forces based on signals of the sensor unit 13 in each of the guiding apparatuses 10, i.e., each of the guiding apparatuses 10 is controlled as described below. The guiding apparatus 10 at the upper right (+X, +Z) and the guiding apparatus 10 at the upper left (−X, +Z) are displaced in the +X and +Y directions and the guiding apparatus 10 at the lower right (+X, −Z) and the guiding apparatus 10 at the lower left (−X, −Z) are displaced in the −X and −Y directions.

Figure 6:
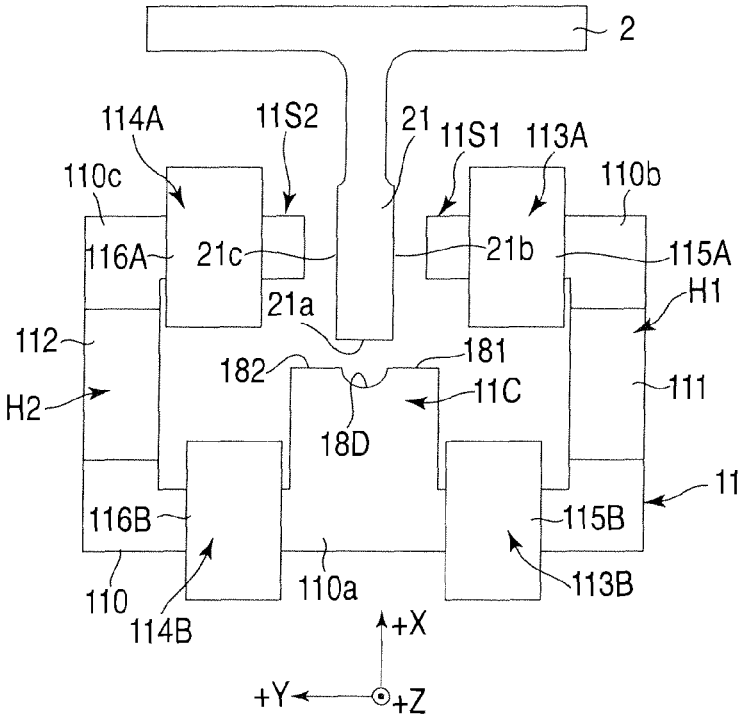
FIG. 6 is a diagram of a modification having a different shape of an end of a central magnetic pole from that of the magnet unit shown in FIG. 4.
Figure 7:
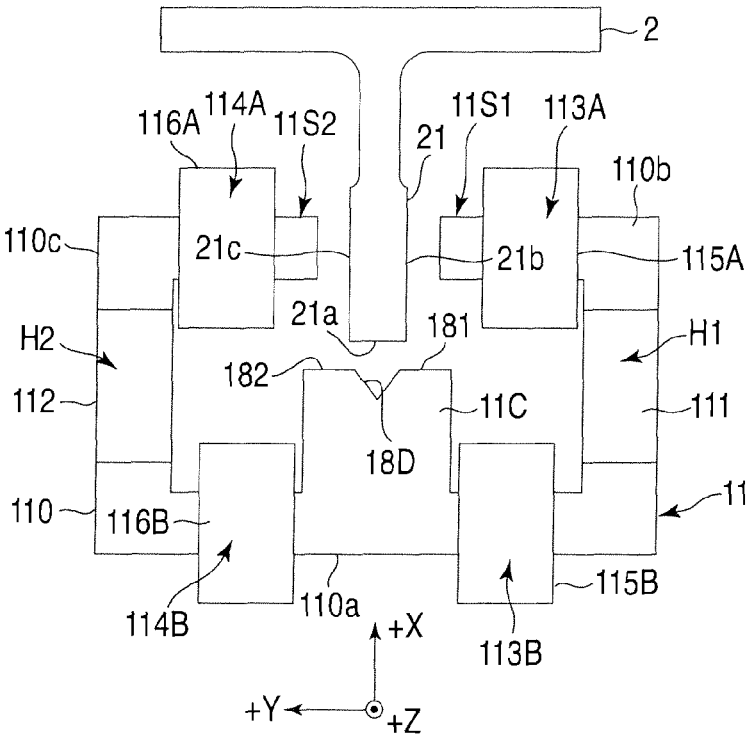
FIG. 7 is a diagram of a modification having a different shape of the end of the central magnetic pole from that of the magnet unit shown in FIG. 4.

FIGS. 6 and 7 each show modifications having different shapes of the tip part of the central magnetic pole 11C when compared with the magnet unit 11 of the guiding apparatus 10 in the first embodiment. In the guiding apparatus 10 shown in FIG. 6, the recess 18D formed between the projected parts 181, 182 of the central magnetic pole 11C is formed as a round groove. In the guiding apparatus 10 shown in FIG. 7, the recess 18D formed between the projected parts 181, 182 of the central magnetic pole 11C is formed as a V-shaped groove. In both cases, the same function and effect are achieved as those of the guiding apparatus 10 shown in FIG. 4.

The guiding apparatuses 10 in the second to fifth embodiments will be described below. The same reference numerals are attached to components having the same functions as those of the guiding apparatus 10 in the first embodiment in figures of each embodiment and a description thereof is omitted. An omitted description should be considered together with corresponding drawings in the first embodiment. Like the guiding apparatus 10 in the first embodiment, as shown in FIG. 1, the guiding apparatuses 10 in the second to fifth embodiments are arranged at four locations of the upper beam 421 and the lower beam 422 of the cage frame 42 of the cage 4 so as to fit into the guide rail 2. Then, each of the guiding apparatuses 10 is configured as shown in FIG. 2 and controlled by the magnetic guide control apparatus 14 so that the posture of the cage 4 is stabilized.

Figure 8:
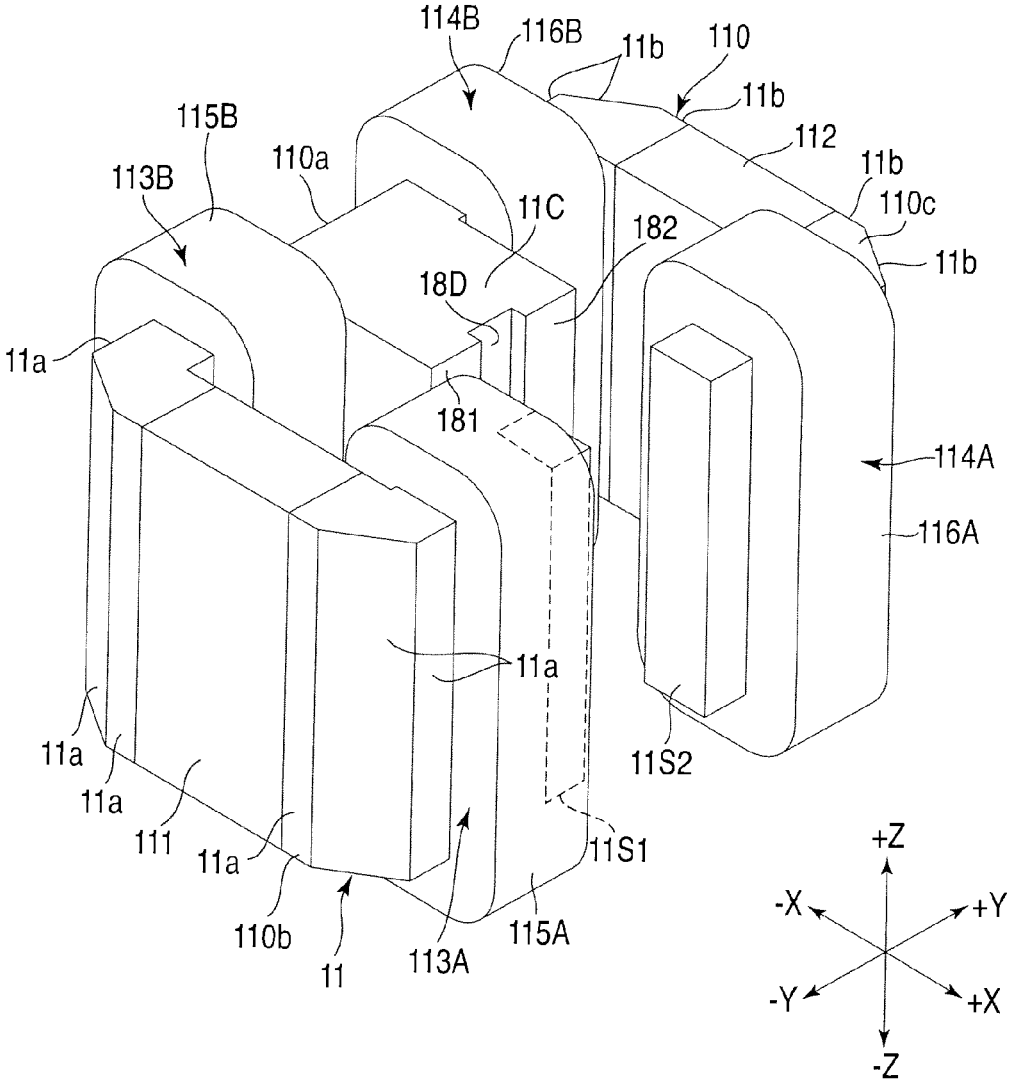
FIG. 8 is a perspective view of a magnet unit of a guiding apparatus according to a second embodiment.
Figure 9:
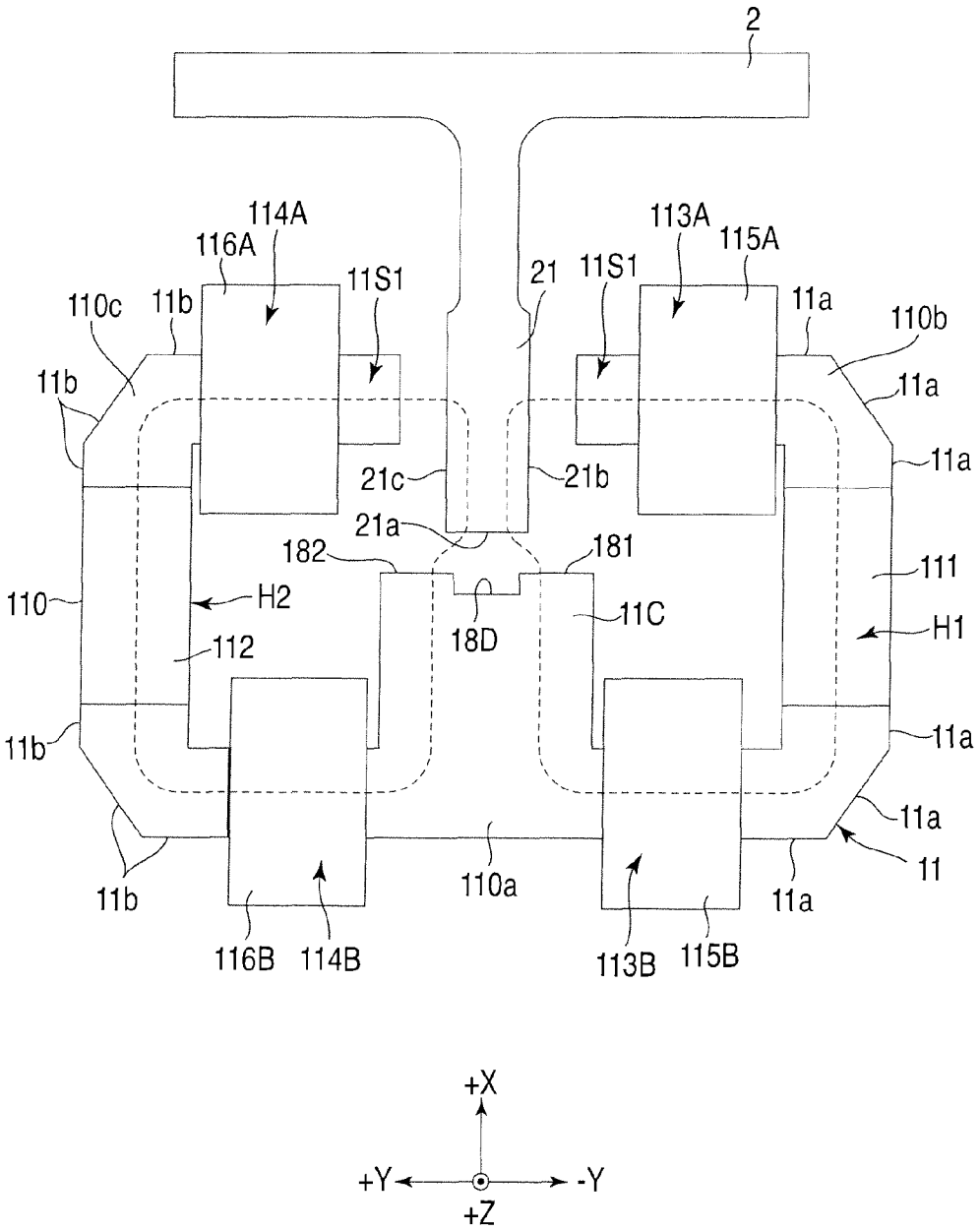
FIG. 9 is a plan view showing a spatial relationship between the magnet unit shown in FIG. 8 and the guide rail.

The guiding apparatus 10 in the second embodiment will be described with reference to FIGS. 8 and 9. When compared with the guiding apparatus 10 in the first embodiment, the guiding apparatus 10 has a different outer circumferential shape of the magnet unit 11. The guiding apparatus 10 connects outer circumferential sides 11*a* adjacent to each other in an interval connecting the central magnetic pole 11C through the first lateral magnetic pole 11S1 and outer circumferential sides 11*b* adjacent to each other in an interval connecting the central magnetic pole 11C through the second lateral magnetic pole 11S2 at an angle of 90 degrees or more at least in one location. More specifically, as shown in FIGS. 8 and 9, this is a shape in which four outer circumferential corners along the Z direction of the magnet unit 11 in the first embodiment are chamfered. That is, outer circumferential sides of the central iron core 110*a*, the first lateral iron core 110*b*, and the second lateral iron core 110*c* on the side where the first permanent magnet 111 or the second permanent magnet 112 is connected are formed at an obtuse angle.

The magnetic resistance of a magnetic circuit formed on an outer circumference of the central iron core 110*a*, the first lateral iron core 110*b*, and the second lateral iron core 110*c* is increased. Thus, the magnetic flux amount that leaks out into a space other than the first magnetic circuit H1 and the second magnetic circuit H2 formed by the guide rails 2 and the magnet unit 11 is reduced. That is, a strong magnetic force is caused to act on the guide rails 2 by increasing the magnetic flux density inside the first magnetic circuit H1 and the second magnetic circuit H2.

Figure 10:
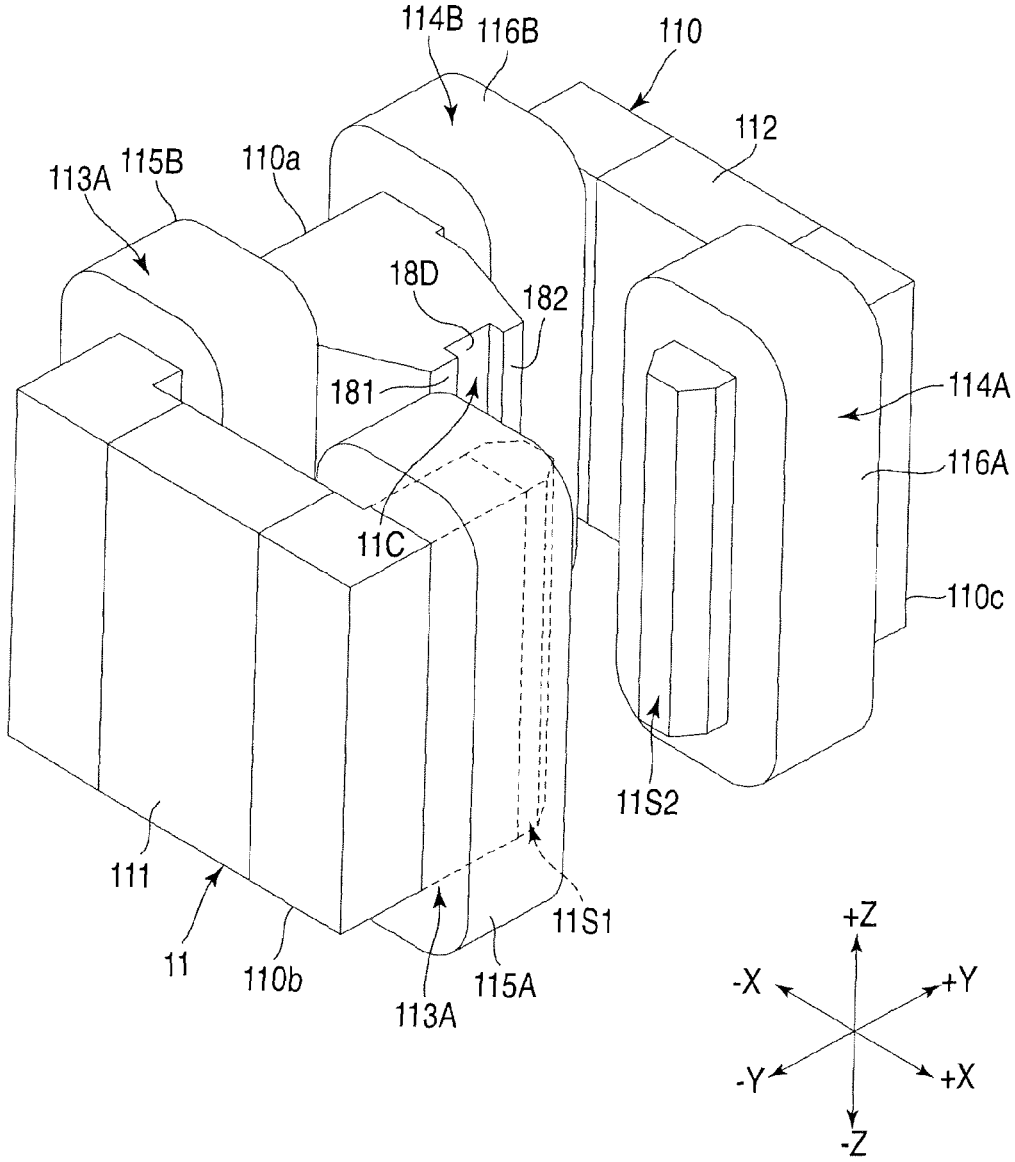
FIG. 10 is a perspective view of a magnet unit of a guiding apparatus according to a third embodiment.
Figure 11:
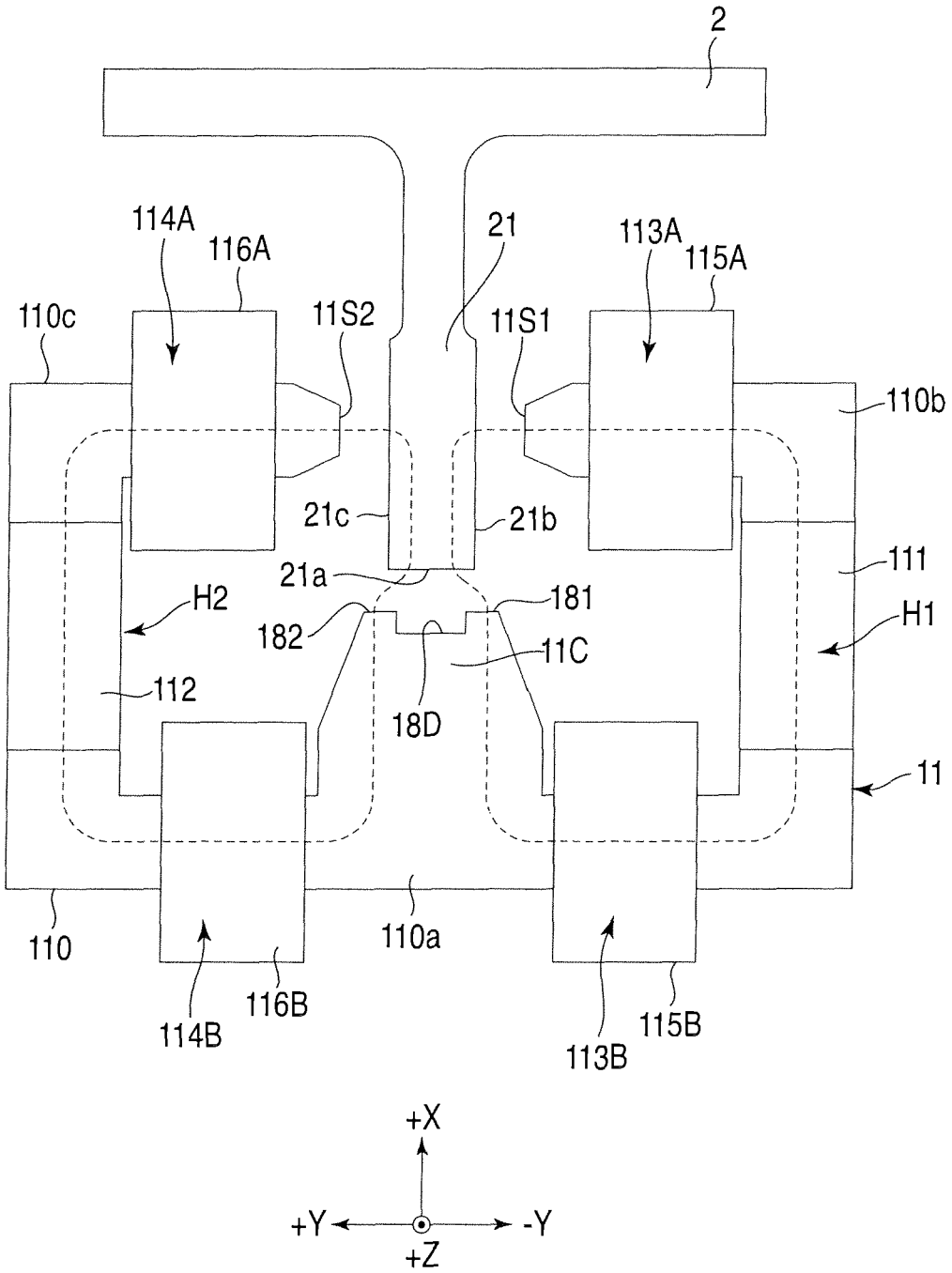
FIG. 11 is a plan view showing the spatial relationship between the magnet unit shown in FIG. 10 and the guide rail.

The guiding apparatus 10 in the third embodiment will be described with reference to FIGS. 10 and 11. When compared with the guiding apparatus 10 in the first embodiment, the guiding apparatus 10 has a different outside shape of at least one magnetic pole. In the guiding apparatus 10, the central magnetic pole 11C, the first lateral magnetic pole 11S1, and the second lateral magnetic pole 11S2 are formed in such a way that the cross section thereof decreases as the guide rail 2 comes closer. In a cross section along a plane crossing the direction in which the guide rail 2 extends, as shown in FIGS. 10 and 11, the end of each magnetic pole is formed in a tapered shape. Accordingly, the magnetic flux density in the tip part of the central magnetic pole 11C, the first lateral magnetic pole 11S1, and the second lateral magnetic pole 11S2 is increased. Therefore, a strong magnetic force is generated between the guide rail 2 and the central magnetic pole 11C, the first lateral magnetic pole 11S1, and the second lateral magnetic pole 11S2.

Moreover, as shown in FIG. 11, individual magnetic poles are tapered. When the distance between magnetic poles of the guiding apparatus 10 in the first embodiment and that of the guiding apparatus 10 in the present embodiment are compared, the shortest distance between the central magnetic pole 11C and the first lateral magnetic pole 11S1 and that between the central magnetic pole 11C and the second lateral magnetic pole 11S2 are both longer in the present embodiment. Thus, the magnetic flux directly connected without passing through the guide rail 2 between the central magnetic pole 11C and the first lateral magnetic pole 11S1 and between the central magnetic pole 11C and the second lateral magnetic pole 11S2 is reduced each.

The width of the tip surface of the central magnetic pole 11C along the width direction of the blade 21 of the guide rail 2 is set to the sum or more of the thickness of the blade 21 of the guide rail 2 and the allowable range of displacement of the cage 4 with respect to the guide rail 2. When the guiding apparatus 10 is displaced with respect to the guide rail 2 within the allowable range of displacement of the cage 4, a stable magnetic force is maintained between the guide rail 2 and the central magnetic pole 11C because the tip surface of the central magnetic pole 11C does not deviate from the front position with respect to the tip surface 21*a* of the guide rail 2.

The guiding apparatus 10 in the fourth embodiment will be described with reference to FIGS. 12 to 14. When compared with the guiding apparatus 10 in the first embodiment, the guiding apparatus 10 has a different outer circumferential shape of the magnet unit 11 and a different outside shape of at least one magnetic pole. In brief, the guiding apparatus 10 has a shape obtained by adding changes from the guiding apparatus 10 in the first embodiment to the guiding apparatus 10 in the second embodiment and to the guiding apparatus 10 in the third embodiment.

Figure 12:
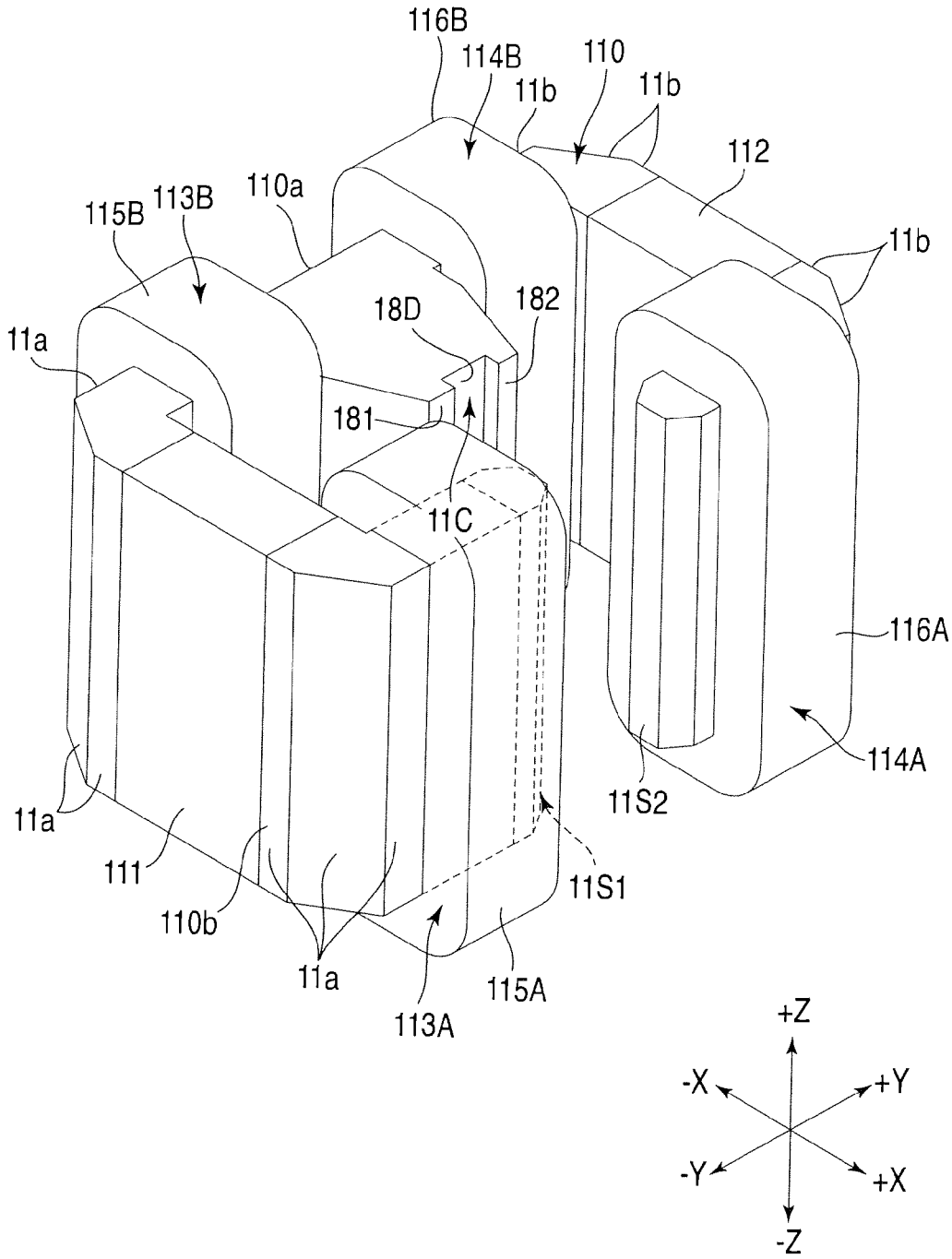
FIG. 12 is a perspective view of a magnet unit of a guiding apparatus according to a fourth embodiment.
Figure 13:
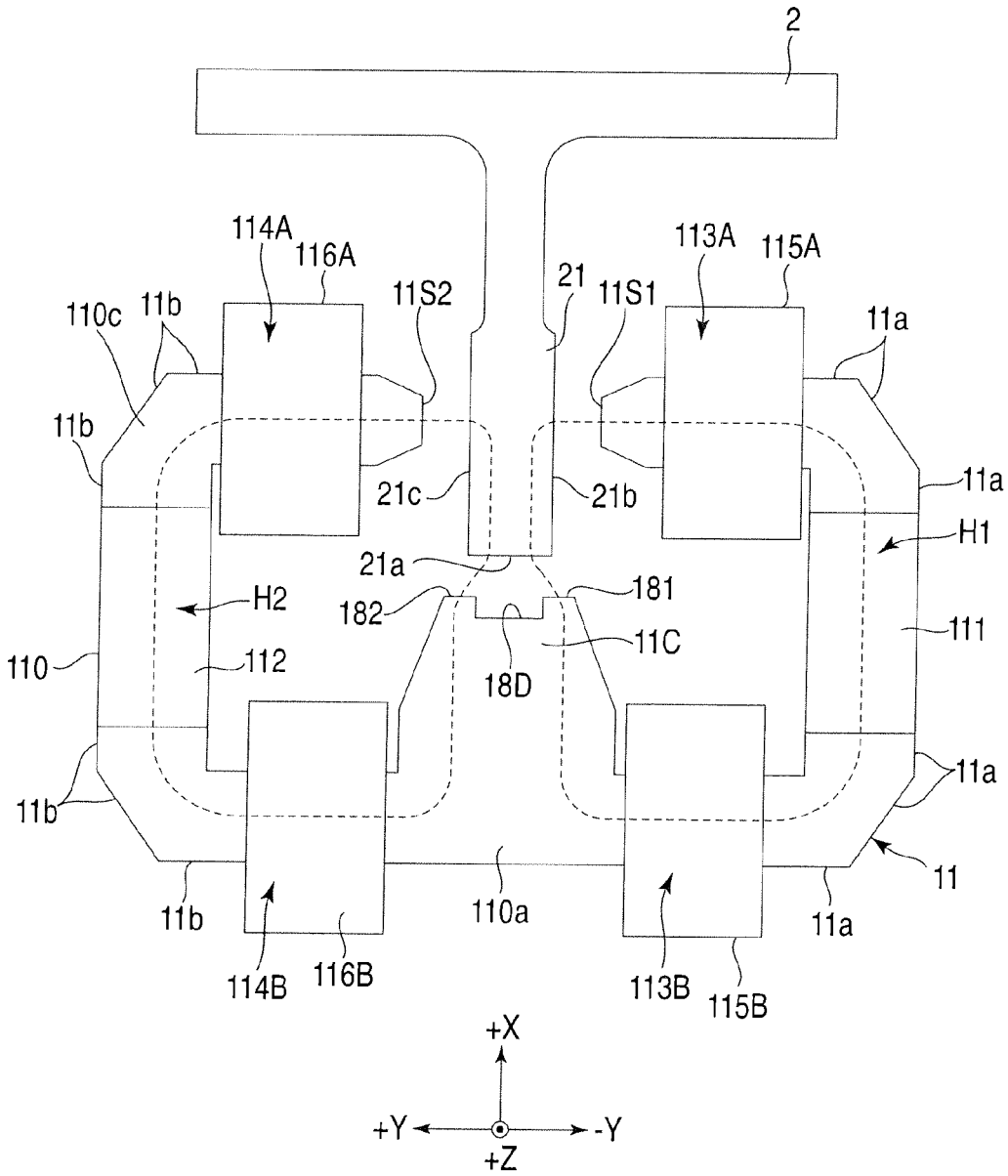
FIG. 13 is a plan view showing the spatial relationship between the magnet unit shown in FIG. 12 and the guide rail.

As shown in FIGS. 12 and 13, the guiding apparatus 10 connects the outer circumferential sides 11*a* adjacent to each other in an interval connecting the central magnetic pole 11C through the first lateral magnetic pole 11S1 at an angle of 90 degrees or more. The guiding apparatus 10 also connects the outer circumferential sides 11*b* adjacent to each other in an interval connecting the central magnetic pole 11C through the second lateral magnetic pole 11S2 at an angle of 90 degrees or more. More specifically, as shown in FIG. 12, this is a shape in which four outer circumferential corners along the Z direction of the magnet unit 11 in the first embodiment are chamfered. That is, outer circumferential sides of the central iron core 110*a*, the first lateral iron core 110*b*, and the second lateral iron core 110*c* on the side where the first permanent magnet 111 or the second permanent magnet 112 is connected are formed at an obtuse angle.

Accordingly, the magnetic resistance of a magnetic circuit formed on an outer circumference of the central iron core 110*a*, the first lateral iron core 110*b*, and the second lateral iron core 110*c* is increased. Thus, the magnetic flux amount that leaks out into a space other than the first magnetic circuit H1 and the second magnetic circuit H2 formed by the guide rails 2 and the magnet unit 11 is reduced. That is, a strong magnetic force is caused to act on the guide rails 2 by increasing the magnetic flux density inside the first magnetic circuit H1 and the second magnetic circuit H2.

Also in the guiding apparatus 10, the central magnetic pole 11C, the first lateral magnetic pole 11S1, and the second lateral magnetic pole 11S2 are formed in such a way that the cross section thereof decreases as the guide rail 2 comes closer. In a cross section along a plane crossing the direction in which the guide rail 2 extends, as shown in FIG. 13, the end of each magnetic pole is formed in a tapered shape. Accordingly, the magnetic flux density in the tip part of the central magnetic pole 11C, the first lateral magnetic pole 11S1, and the second lateral magnetic pole 11S2 is increased. As a result, a strong magnetic force is generated between the guide rail 2 and the central magnetic pole 11C, the first lateral magnetic pole 11S1, and the second lateral magnetic pole 11S2.

Also in the guiding apparatus 10 according to the fourth embodiment, as shown in FIG. 13, individual magnetic poles are tapered. When the distance between magnetic poles of the guiding apparatus 10 in the first embodiment and that of the guiding apparatus 10 in the present embodiment are compared, the shortest distance between the central magnetic pole 11C and the first lateral magnetic pole 11S1 and that between the central magnetic pole 11C and the second lateral magnetic pole 11S2 are both longer in the present embodiment. Thus, the magnetic flux directly connected without passing through the guide rail 2 between the central magnetic pole 11C and the first lateral magnetic pole 11S1 and between the central magnetic pole 11C and the second lateral magnetic pole 11S2 is reduced each.

The width of the tip surface of the central magnetic pole 11C along the width direction of the blade 21 of the guide rail 2 is set to the sum or more of the thickness of the blade 21 of the guide rail 2 and the allowable range of displacement of the cage 4 with respect to the guide rail 2. When the guiding apparatus 10 is displaced with respect to the guide rail 2 within the allowable range of displacement of the cage 4, the tip surface of the central magnetic pole 11C does not deviate from the front position with respect to the tip surface 21*a* of the guide rail 2. Therefore, a stable magnetic force is maintained between the guide rail 2 and the central magnetic pole 11C.

As shown in FIG. 13, the main magnetic flux of the first magnetic circuit H1 passes through the projected part 181 of the central magnetic pole 11C and that of the second magnetic circuit H2 passes through the projected part 182 of the central magnetic pole 11C. As a result, the magnetic flux is formed diagonally with respect to the tip surface 21*a* of the blade 21 of the guide rail 2. Therefore, the central magnetic pole 11C causes the magnetic force to act so that the guide rail 2 is attracted not only in the −X direction, but also in the −Y direction through the projected part 181 and in the +Y direction through the projected part 182.

Figure 14:
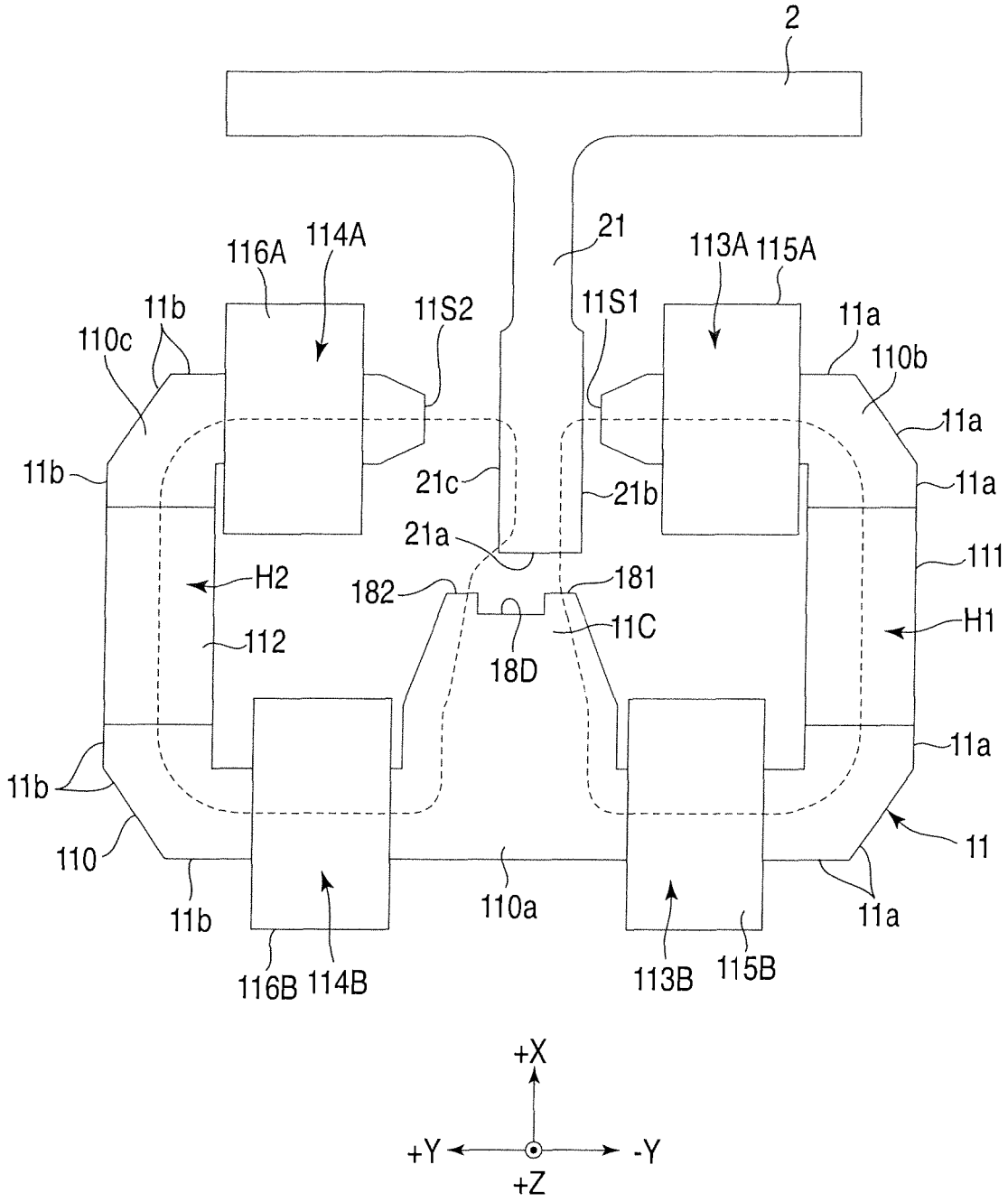
FIG. 14 is a plan view when the magnet unit shown in FIG. 13 is displaced in the thickness direction of the blade with respect to the guide rail.

The guiding apparatus 10 is controlled by the magnetic guide control apparatus 14 so that, the cage 4 is displaced in the +Y direction as shown in FIG. 14, as same as the first embodiment, when the cage 4 is subjected to an external force in the −Y direction. As a result, the magnetic force of the first permanent magnet 111 or the second permanent magnet 112 of the magnet unit 11 is balanced against the received external force.

The projected part 181 on the −Y side of the central magnetic pole 11C increases an area facing the tip surface 21*a* of the blade 21 of the guide rail 2 when the guiding apparatus 10 is displaced in the +Y direction with respect to the guide rail 2 as shown in FIG. 14. The projected part 182 on the +Y side decreases the area facing the tip surface 21*a* of the guide rail 2 or does not face the tip surface 21*a* at all. As a result, the magnetic flux increases on the side closer to the guide rail 2, for example, in FIG. 14, in the first magnetic circuit H1 formed on the side of the first lateral magnetic pole 11S, making the magnetic force stronger. Moreover, a magnetic force having a −Y direction component diagonally acts between the projected part 181 and the tip surface 21*a* of the guide rail 2. That is, the magnetic force generated by the central magnetic pole 11C assists that of the first lateral magnetic pole 11S1. Therefore, the guiding apparatus 10 improves the force to support the cage 4 when compared with the guiding apparatus 10 in the first embodiment by concentrating the magnetic flux.

Figure 15:
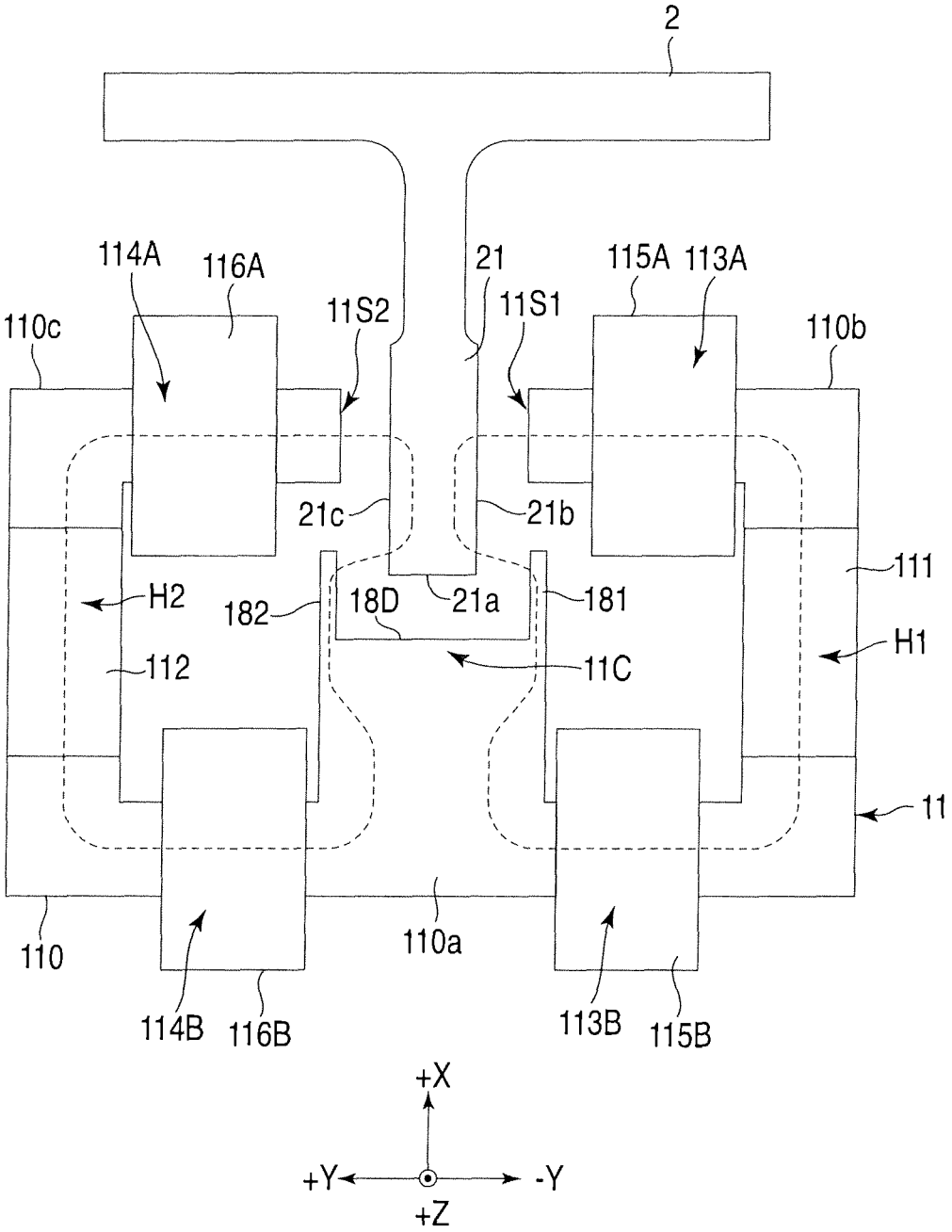
FIG. 15 is a plan view showing the spatial relationship between a magnet unit of a guiding apparatus according to a fifth embodiment and the guide rail.

The guiding apparatus 10 according to the fifth embodiment will be described with reference to FIGS. 15 and 16. The guiding apparatus 10 has a different tip part shape of the central magnetic pole 11C from that of the guiding apparatus 10 in the first embodiment. Internal dimensions of the recess 18D formed between the projected parts 181, 182 of the central magnetic pole 11C in the guiding apparatus 10 are, as shown in FIG. 15, greater than the sum of the thickness of the blade 21 of the guide rail 2 and the allowable range of displacement of the cage 4 with respect to the guide rail 2. Moreover, when the central magnetic pole 11C is positioned closest to the guide rail 2 in the −X direction in which the blade 21 of the guide rail 2 extends within the allowable range of displacement of the cage 4, the tips of the projected parts 181, 182 extend beyond the tip surface 21*a* of the blade 21 of the guide rail 2. That is, when the cage 4 is displaced in a direction in which the cage 4 is brought closer to the blade 21 of the guide rail 2, the central magnetic pole 11C will enclose the tip part of the guide rail 2.

Most magnetic fluxes arranged in the central magnetic pole 11C by the first permanent magnet 111 and the second permanent magnet 112 of the guiding apparatus 10 are formed, like the main magnetic flux shown by broken lines in FIG. 15, diagonally or along the thickness direction of the blade 21 of the guide rail 2 from the side facing the guide rail 2 of the projected parts 181, 182 extending from both sides of the central magnetic pole 11C to the side on the −Y side and the side on the +Y side of the guide rail 2. Therefore, the guiding apparatus 10 in the present embodiment generates, when compared with the guiding apparatuses 10 in the first to fourth embodiments, a stronger magnetic force by the central magnetic pole 11C in the −Y direction or the +Y direction.

Figure 16:
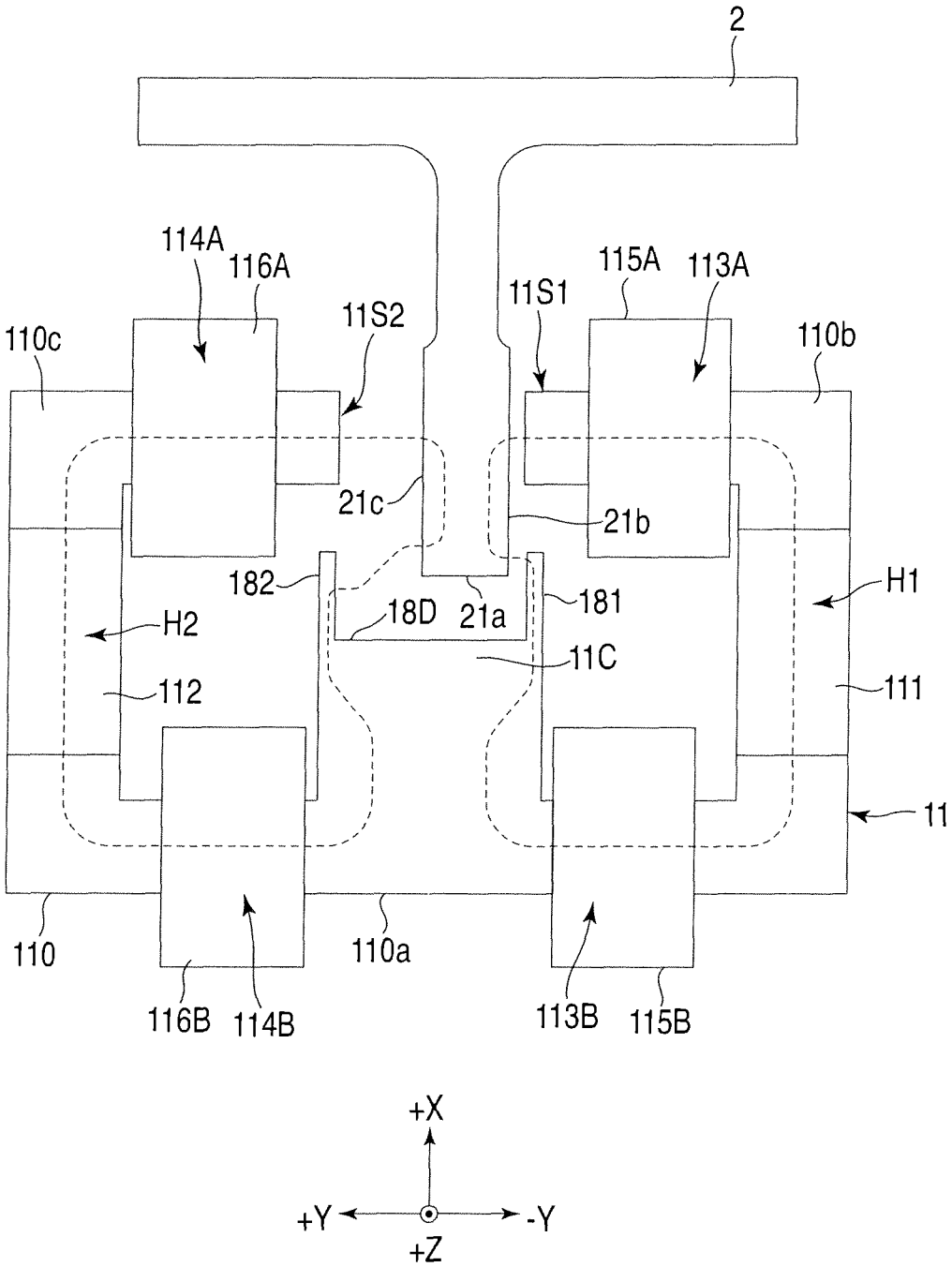
FIG. 16 is a plan view when the magnet unit shown in FIG. 15 is displaced in the thickness direction of the blade with respect to the guide rail.

When the cage 4 is subjected to an external force in the −Y direction, the guiding apparatus 10 controls the first electromagnets 113A, 113B and the second electromagnets 114A, 114B through the magnetic guide control apparatus 14 so that, as shown in FIG. 16, the magnet unit 11 is displaced in the +Y direction. Accordingly, the magnetic resistance between the first lateral magnetic pole 11S1 and the guide rail 2 is decreased by the first lateral magnetic pole 11S1 being brought closer to the side 21*b* on the −Y side of the guide rail 2, reinforcing the magnetic force. Moreover, with the projected part 181 being brought closer to the side 21*b* on the −Y side, the magnetic resistance between the projected part 181 and the guide rail 2 decreases, reinforcing the magnetic force to attract the guide rail 2 in the −Y direction by the projected part 181. Actually, the guide rail 2 is fixed and thus, the magnetic force displacing the guiding apparatus 10 in the +Y direction is reinforced. Therefore, the guiding apparatus 10 exerts a stronger magnetic force by the first permanent magnet 111 and the second permanent magnet 112 in the Y direction than the guiding apparatuses 10 in the first to fourth embodiments.

As shown in FIGS. 15 and 16, the bottom of the recess 18D is apart from the tip surface 21*a* of the blade 21 of the guide rail 2 by a fixed distance. Thus, when the cage 4 is subjected to an external force in the −X direction, the guiding apparatus 10 balances the magnetic force by the first permanent magnet 111 and the second permanent magnet 112 against the received external force by displacing the guiding apparatus 10 in the +X direction in which the guiding apparatus 10 is brought closer to the guide rail 2 through the magnetic guide control apparatus 14.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A guiding apparatus comprising:

a pair of guide rails laid in a vertical direction inside an elevator-shaft and configured to be formed of a magnetic substance;

a magnet unit comprising an electromagnet, a permanent magnet, and magnetic poles configure to face to an blade of the guide rail from three directions with a gap;

a pedestal configured to fasten the magnet unit to a cage arranged between the guide rails;

a sensor unit configured to detect physical quantities in a magnetic circuit formed by the guide rails and the magnet unit;

a control unit configured to control a current passed through the electromagnet based on the physical quantities to support the cage with respect to the guide rails in a noncontact manner; and projected parts configured to formed at each of both ends of a tip portion of a central magnetic pole, which is among the magnetic poles of the magnet unit, opposite to a tip surface of the blade of the guide rail, the projected part being closer to the guide rail than a center part thereof.

2. The guiding apparatus of claim 1, wherein the central magnetic pole comprises a recess having internal dimensions equal to or smaller than a thickness of the blade of the guide rail between the projected parts.

3. The guiding apparatus of claim 1, wherein the central magnetic pole comprises the tip part having external dimensions equal to or greater than a sum of a thickness of the blade of the guide rail and an allowable range of displacement of the cage with respect to the guide rail along a thickness direction of the blade of the guide rail.

4. The guiding apparatus of claim 1, wherein the projected part of the central magnetic pole has external dimensions equal to or greater than a sum of a thickness of the blade of the guide rail and an allowable range of displacement of the cage with respect to the guide rail along a thickness direction of the blade of the guide rail.

5. The guiding apparatus of claim 1, wherein the central magnetic pole comprises a recess between the projected parts, the recess having internal dimensions greater than a sum of a thickness of the blade of the guide rail and an allowable range of displacement of the cage with respect to the guide rail, and the projected parts of the central magnetic pole extend beyond the tip surface of the blade of the guide rail when the central magnetic pole is positioned closest to the guide rail in a direction in which the blade of the guide rail extends within the allowable range of displacement of the cage.

6. The guiding apparatus of claim 1, wherein two magnetic poles other than the central magnetic pole among the magnetic poles of the magnet unit are a first lateral magnetic pole and a second lateral magnetic pole that are homopolar, comprise a different polarity from that of the central magnetic pole, and are arranged on both sides of the blade of the guide rail opposite to each other in a thickness direction and in a direction perpendicular to the central magnetic pole, the magnet unit comprising:

an iron core comprising the central magnetic pole, the first lateral magnetic pole, and the second lateral magnetic pole each at ends thereof;

a first permanent magnet arranged between the central magnetic pole and the first lateral magnetic pole in an orientation in which the polarity of each is formed in the central magnetic pole and the first lateral magnetic pole;

a second permanent magnet arranged between the central magnetic pole and the second lateral magnetic pole in an orientation in which the polarity of each is formed in the central magnetic pole and the second lateral magnetic pole;

a first electromagnet comprising a first coil wound around the iron core in an orientation crossing a first main magnetic flux of a first magnetic circuit passing through the first permanent magnet; and a second electromagnet comprising a second coil wound around the iron core in an orientation crossing a second main magnetic flux of a second magnetic circuit passing through the second permanent magnet.

7. The guiding apparatus of claim 6, wherein the magnet unit connects outer circumferential sides adjacent to each other in an interval connecting the central magnetic pole through the first lateral magnetic pole and outer circumferential sides adjacent to each other in an interval connecting the central magnetic pole through the second lateral magnetic pole at an angle of 90 degrees or more at least in one location.

8. The guiding apparatus of claim 6, wherein at least one of the central magnetic pole, the first lateral magnetic pole, and the second lateral magnetic pole is formed in such a way that a cross section thereof decreases as the guide rail comes closer.

9. The guiding apparatus of claim 6, wherein the first coil is provided in at least one of intervals between the central magnetic pole and the first permanent magnet and between the first permanent magnet and the first lateral magnetic pole, and the second coil is provided in at least one of intervals between the central magnetic pole and the second permanent magnet and between the second permanent magnet and the second lateral magnetic pole.

10. The guiding apparatus of claim 1, wherein the control unit controls the current passed through the electromagnet to stabilize a posture of the cage based on the physical quantities and also to converge the current passed through the electromagnet to zero maintaining the noncontact manner regardless of whether there is an external force acting on the cage.

* * * * *